US005966145A

United States Patent [19]

Miura et al.

[11] Patent Number: 5,966,145

[45] **Date of Patent: *Oct. 12, 1999**

[54] INK JET PRINTING ON THE FULL WIDTH OF A PRINTING MEDIUM

[75] Inventors: Yasushi Miura, Kawasaki; Tokihide Ebata, Yokohama, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,587

[22] Filed: Jan. 29, 1997

Related U.S. Application Data

[63] Continuation of application No. 08/215,623, Mar. 22, 1994, abandoned.

[30] Foreign Application Priority Data

Mar. 26, 1993 [JP] Japan ..... 5-068472

[51] Int. Cl.[6] ..... B41J 29/38; B41J 2/165; B41J 2/145

[52] U.S. Cl. ..... 347/9; 347/33; 347/40

[58] Field of Search ..... 347/40, 9, 105, 347/33, 104, 100, 37, 35

[56] References Cited

U.S. PATENT DOCUMENTS

| | | | |
|---|---|---|---|
| 3,925,787 | 12/1975 | Suzuki | 347/37 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,725,849 | 2/1988 | Koike et al. | 347/106 |
| 4,740,796 | 4/1988 | Endo et al. | 347/56 |
| 4,755,877 | 7/1988 | Vollert | 358/285 |
| 4,849,770 | 7/1989 | Koike et al. | 347/105 |
| 4,958,236 | 9/1990 | Nagashima et al. | 358/455 |
| 5,225,852 | 7/1993 | Uchida et al. | 347/33 |
| 5,298,926 | 3/1994 | Fukushima et al. | 347/34 |
| 5,371,531 | 12/1994 | Rezanka et al. | 347/43 |
| 5,459,502 | 10/1995 | Sasaki et al. | 347/100 |
| 5,468,553 | 11/1995 | Koike et al. | 347/103 |

FOREIGN PATENT DOCUMENTS

| | | |
|---|---|---|
| 0558236 | 2/1993 | European Pat. Off. . |
| 59-123670 | 7/1984 | Japan . |
| 59-138461 | 8/1984 | Japan . |
| 63-031594 | 6/1988 | Japan . |
| 03046589 | 7/1991 | Japan . |
| 5286129 | 11/1993 | Japan . |
| 8601775 | 3/1986 | WIPO . |

*Primary Examiner*—N. Le
*Assistant Examiner*—Thinh Nguyen
*Attorney, Agent, or Firm*—Fitzpatrick, Cella, Harper & Scinto

[57] ABSTRACT

A serial type ink jet printing apparatus for textile printing sets a print beginning position and a print ending position so that the space between the print beginning position and the print ending position is wider than the textile printing medium. When the printing operation is performed, a small amount of ink is discharged from an ink jet head onto a textile support member before the head reaches the textile printing medium, by which ink with high viscosity can be exhausted in a continuous printing operation before printing on the textile. Therefore, the textile can be efficiently printed entirely from edge to edge with high quality, and a separate ink receiver for receiving the preliminarily discharged ink is rendered unnecessary.

56 Claims, 16 Drawing Sheets

INK JET PRINTING ON THE FULL WIDTH OF A PRINTING MEDIUM

This application is a continuation of application Ser. No. 08/215,623 filed Mar. 22, 1994 now abandoned.

BACKGROUND OF THE INVENTION

1. Field of the Invention

The present invention relates to an apparatus and method for ink jet printing, and, more particularly, to an apparatus and method in which printing is performed by ink discharged from a discharge port and attached onto a printing medium such as a textile.

2. Related Background Art

An ink jet head applicable to an ink jet printing apparatus generally has a discharge port for discharging ink, a liquid channel for supplying ink to the discharge port, an energy acting portion in the liquid channel and energy generating means for generating energy which acts on ink in the energy acting portion to discharge ink from the discharge port.

Exemplary energy generating means are an electromechanical converter such as a piezoelectric element or the like, electromagnetic wave energy generating means for applying an electromagnetic wave such as a laser or the like to the ink to form flying liquid droplets, or an electrothermal converter, all which have been well-known.

An ink jet printing head provided with heat energy generating means generally uses electrothermal converters as the heat energy generating means, and has electrodes, liquid passage walls and a top plate provided on a substrate through processes like those used for manufacturing semiconductors, which processes incorporate various techniques including etching, vapor deposition, sputtering or the like. Since the ink discharge ports used for forming the flying liquid droplets required for printing can be readily arranged with high density, such an ink jet printing head has the following advantages.

a) The ink jet printing head can be easily fabricated and it can perform high resolution printing.

b) A compact constitution of the ink jet printing head can be provided.

c) In the process of manufacturing the recording head, the advantages of IC (integrated circuit) technology or miniaturization technology, which have been recently significantly improved from the viewpoint of reliability and progress in the field of semiconductor manufacturing, can be adopted as much as possible. It is also possible to provide a recording head with a two-dimensional array of discharge ports.

With the above-described points considered, a multi-nozzle recording head with high nozzle density can be attained without difficulty, and a large quantity of recording heads can be manufactured with high productivity and at low production cost.

It is known to provide such a printing head, using an electrothermal converter as the heat energy generating means and manufactured through processes of manufacturing semiconductors and having multi-nozzles, with a liquid passage corresponding to each ink discharge port, an electrothermal converter in each liquid passage, and a common liquid chamber from which ink is supplied to the liquid passages.

FIG. 15 shows an example of a conventional ink jet printing head 1401 provided with such heat energy generating means. This printing head has electrothermal converters as heat energy generating means 1403, electrodes 1404, liquid passage walls 1405 and a top plate 1406 provided on a substrate 1402, manufactured using processes for manufacturing semiconductors that use various techniques including etching, vapor deposition, sputtering or the like.

Printing liquid (ink) 1412 is supplied from a printing-liquid tank (not shown) to the common liquid chamber 1408 of the printing head 1401 through a liquid supply pipe 1407 connected to the chamber 1408 by a connector 1409. The printing liquid 1412 supplied to the common liquid chamber 1408 is supplied to liquid passages 1410 in accordance with capillary phenomena and forms a meniscus in each liquid discharge port or nozzle 1411 at the corresponding end of each liquid passage 1410 to stably retain the liquid at the corresponding port 1411.

To discharge the printing liquid by utilizing the printing head constructed above, for instance, the electrothermal converters 1403 are energized. As a result, printing liquid located on and in the vicinity of the electrothermal converters 1403 is rapidly heated. The rapid heating thereof produces film boiling in the printing liquid 1412, which forces liquid droplets to be discharged from the liquid discharge ports 1411. Such an ink jet printing head can be obtained with ease and high productivity, with an arrangement of liquid discharge ports at a high density such as 16 ports/mm, for example and with multiple (128 to 256) nozzles.

Among the ink jet printing apparatus using such a head, a serial type printing apparatus adopts a serial scan method of scanning the head in a main-scan direction crosswise to the sub-scan printing medium conveying direction. The printing head is mounted on a carriage movable in a main-scan direction along the printing medium, and the printing medium is fed in the sub-scan direction by a predetermined amount corresponding to the length of the array of liquid discharge ports on the printing head, whereby the next line of the image can then be printed on the printing medium. The head scanning and printing medium conveying are thus repeated until the entire printing medium has been printed.

In order to prevent non-discharge or misdischarge of ink from the printing head during a printing operation and to recover the discharge capabilities of the printing head, a recovery operation is properly performed on the printing head before the start of a printing operation. This is necessary in part because the printing operation is performed by repeatedly discharging ink from the ink jet printing head shown in FIG. 15, which also produces numerous minute satellite ink mist droplets. This ink mist attaches and accumulates on a discharge face of the printing head 1401. When the amount of the ink mist is large, it can clog the ink discharge ports and prevent ink discharge. In addition, faulty ink discharge can be caused by adhesion of foreign matter on the discharge face or invasion of foreign matter or air into the liquid channels.

In order to solve these problems, a recovery operation is performed; for example, ink is forcibly circulated between the ink jet head and the ink tank to remove the cause of ink non-discharge or misdischarge.

In such a serial type printing method, the printing head can be mounted on a compact printer, which has the advantage of easy handling and installation. The same printing head can also be mounted on a large-size printer that can print on a printing medium having a long width in the scanning direction of the printing head, and therefore printers for various applications can use the same printing head.

FIG. 16 is a perspective view showing one type of conventional printing apparatus using the ink jet printing head shown in FIG. 15.

The ink jet printing apparatus is largely constituted of a frame 1506, two guide rails 1507 and 1508, an ink jet head 1509 and a carriage 1510 for the movement thereof, an ink supply device 1511 and a carriage 1512 for the movement thereof, a head recovery device 1513, and an electronic system 1505.

The ink jet head 1509 (hereinafter sometimes referred to simply as a head) comprises a plurality of columns of discharge ports which respectively discharge ink of magenta (M), cyan (C), yellow (Y) and black (BK), and converters for converting an electric signal into energy for use in discharging the ink, and is further provided with means for generating the electric signals for selectively discharging the ink through the columns of discharge ports in accordance with an image signal sent from an image processing unit. The head may be a print head which discharges the ink by the use of heat energy, as discussed above in connection with FIG. 15.

As discussed above, the apparatus forms an image 1517 (indicated by shading in FIG. 16) on the printing medium 1536 by repeatedly scanning the head 1509 in the main scanning direction H. After each scan, the recording medium is advanced in the sub-scanning direction B and the head 1509 is scanned across the printing medium again. This is repeated until the entire image is recorded. FIG. 16 illustrates unrecorded bands at the edges of the printing medium produced with conventional apparatus.

The ink supply device 1511 serves to store ink and supply a necessary amount to the head, and comprises an ink tank and an ink pump (both not shown) or other components. This device 1511 and the head 1509 are connected via an ink supply tube 1515, whereby the head 1509 is automatically supplied with the ink, owing to its capillary action, in an amount corresponding to that discharged. In a head recovery operation that will be later described, ink is compulsorily supplied to the head 1509 by using the ink pump.

The head 1509 and the ink supply device 1511 are mounted on the head carriage 1510 and the ink carriage 1512, respectively, for reciprocal movement along the guide rails 1507, 1508 by a driving device, not shown.

The head recovery device 1513 is provided at a home position (waiting position) of the head and opposed to the head. It maintains the stability of ink discharge from the head 1509, and is movable forward and a backward in the direction of the arrow A to perform the following specific operations.

First, the head recovery device 1513 provides a cap for the head 1509 at the home position (capping operation) to retard the evaporation of ink from the nozzles of the head 1509. Further, it serves in the operation of compulsory discharge of ink through the nozzles by pressurizing the ink flow channels within the head 1509 using an ink pump (a pressure recovery operation) to force bubbles or dirt out of the nozzles into the cap before the start of image recording, or performs an operation of sucking ink through the nozzles (a suction recovery operation).

The head recovery device also can clean the discharge surface of the head 1509 by wiping the discharge surface to prevent an unstable discharge condition, when ink mist, generated incidentally with the discharge of ink during a printing operation, attaches on or adjacent to the discharge port.

An ink receiver 1540 is located between a platen 1532 and the head recovery device 1513 for receiving preliminarily ejected ink. The ink receiver comprises plural caps and is positioned corresponding to the height of each head. When the printing duty of a particular image is low, some ink discharge ports may not be used during a printing operation, so that the viscosity of the ink in such ports may increase due to evaporation of the ink solvent. To prevent this condition from affecting ink discharge, the ink jet head is driven by predetermined drive pulses, and the ink is discharged from all discharge ports, prior to a printing operation. This operation is called "purging."

The above-mentioned preliminary discharge (purging) is also performed to prevent color mixture that can be caused by the head recovery device which wipes the discharge face of the ink jet head. When wiping the discharge face, the wiping is performed using a blade of rubber-like material. In this operation, the different colors of ink are sometimes forced into other discharge ports and cause a color mixture in those ports. However, the mixed-color ink will be discharged to the ink receiver as a result of such preliminary discharge, and therefore improper color mixture on the printing medium can be prevented.

The ink jet printing apparatus constructed as just described can print a fine image at high speeds, and noise produced during the printing operation is low because the printing is done without impacting the printing medium. In addition, since the printer uses multi-colored inks and can easily print a color image, the ink jet printer can be used with a computer and wordprocessor or the like, or as printing means in a stand-alone printing machine such as a copying machine, a printer, a facsimile machine or the like.

On the other hand, in recent years, in addition to the usual print mediums, such as plastic sheets for an overhead projector, or processed paper with punched holes or paper with perforations, free-sized paper and woven cloth are desired to be used as the print medium. As to the size of the print medium, for example, a sheet to be used for an advertisement or woven cloth to be used for clothes, large-size print mediums are sometimes necessary.

It has been proposed that such an ink jet printing apparatus be used for textile printing by discharging the ink directly onto the cloth (see, for example, Japanese Patent Publication No. 63-31594). In such ink jet printing, as distinguished from the case of printing characters on a printing medium, the edge portion of the print medium must be printed. Therefore, the print head must be in good ink discharge condition as soon as it begins to print from the edge portion of the print medium. Accordingly, to accomplish high quality printing, it is necessary to complete the discharge recovery operation and the preliminary discharge operation before beginning printing on the print medium.

According to the aforementioned conventional ink jet printing apparatuses, as stated above, it is necessary to perform separate discharge recovery and preliminary discharge operations before the printing operation begins. Because the ink receiver must be provided in the printing apparatus, it is difficult to make the printing apparatus compact. In addition, the high viscosity ink collected in such operations can be difficult to handle. In addition, the printing operation must be interrupted for preliminary discharge of ink to the ink receiver, and therefore the time to complete a printing operation is increased.

SUMMARY OF THE INVENTION

The present invention is designed to overcome the above problems in conventional structure. It is accordingly an object of the present invention to provide a small-sized ink jet printer capable of continuously printing an image up to the edges of a printing medium.

In accordance with one aspect of the present invention, an ink jet printing apparatus, for recording an image using a printing head to discharge ink onto a printing medium having a predetermined width in response to drive signals supplied to the printing head, comprises control means for setting a print width of the printing head extending between a print beginning position and a print ending position, wherein the print width of the printing head is greater than the width of the printing medium, and drive signal supply means for supplying the drive signals to the printing head to discharge ink therefrom from the print beginning position to the print ending position.

In accordance with another aspect of the invention, the printing head is a scanning printing head that scans the printing medium between the print beginning position to the print ending position.

In accordance with yet another aspect of the present invention, an ink jet printing apparatus for recording an image on a printing medium comprises scanning means for moving a printing head relative to the printing medium and beyond edges thereof in a width direction, sub-scanning means for conveying the printing medium in a sub-scanning direction transverse to the direction of movement of the printing head, control means for setting a print beginning position and a print ending position for the scanning means, wherein the print beginning position is spaced a predetermined distance from one edge of the printing medium in the width direction and the print ending position is spaced a predetermined distance from another edge of the printing medium in the width direction, and drive signal supply means for supplying drive signals to the printing head to discharge ink therefrom while the printing head is moved by said scanning means, wherein the drive signal supply means supplies drive signals to the printing head to discharge ink therefrom from the print beginning position to the print ending position.

In accordance with a further aspect of the invention, a textile printing apparatus comprises:

an ink jet printing apparatus including at least one printing head having a plurality of discharge orifices for discharging ink toward a textile printing medium in response to drive signals corresponding to an image to be printed on the printing medium, a scanning mechanism for moving the printing head relative to the printing medium and beyond edges thereof in a width direction, a sub-scanning mechanism for conveying the printing medium in a sub-scanning direction transverse to the direction of movement of the printing head, control circuitry for setting a print beginning position and a print ending position for the scanning mechanism, wherein the print beginning position is spaced a predetermined distance from one edge of the printing medium in the width direction and the print ending position is spaced a predetermined distance from another edge of the printing medium in the width direction, and drive signal supply circuitry for supplying drive signals to the printing head to discharge ink therefrom while the printing head is moved by the scanning mechanism, wherein the drive signal supply circuitry supplies drive signals to the printing head to discharge ink therefrom from the print beginning position to the print ending position;

means for drying the printing medium after recording the image thereon;

means for fixing the colors in the printing medium; and means for cleaning the printing medium having the color fixed therein.

In accordance with still another aspect of the present invention, an ink jet printing method for recording an image using a scanning printing head to discharge ink in response to drive signals while scanning a printing medium having a predetermined width comprises the steps of setting a print beginning position and a print ending position for the scanning printing head, wherein the distance between the print beginning position and the print ending position is greater than the width of the printing medium, and supplying the drive signals to the printing head to discharge ink therefrom from the print beginning position to the print ending position.

The term "print" or "printing" as used in connection with the present invention includes textile printing and all other kinds of printing. The purpose of printing according to the present invention is not limited and various kinds of printing medium may be used. The printing medium may be cloth, wall cloth, paper, wallpaper and plastic films for an overhead projector or the like. "Cloth" may include all woven or nonwoven fabrics and other cloth, irrespective of materials and how it is woven or knitted, and "wallpaper" includes a sheet made of paper, cloth, plastic material such as polyvinylchloride, or any other material, to be attached to a wall.

The present invention can be directed to office use, but it is especially advantageous in industrial applications.

DETAILED DESCRIPTION OF THE PREFERRED EMBODIMENTS

Embodiments of ink jet printing apparatus according to the present invention will be described in detail with reference to the accompanying drawings.

Figure 1:
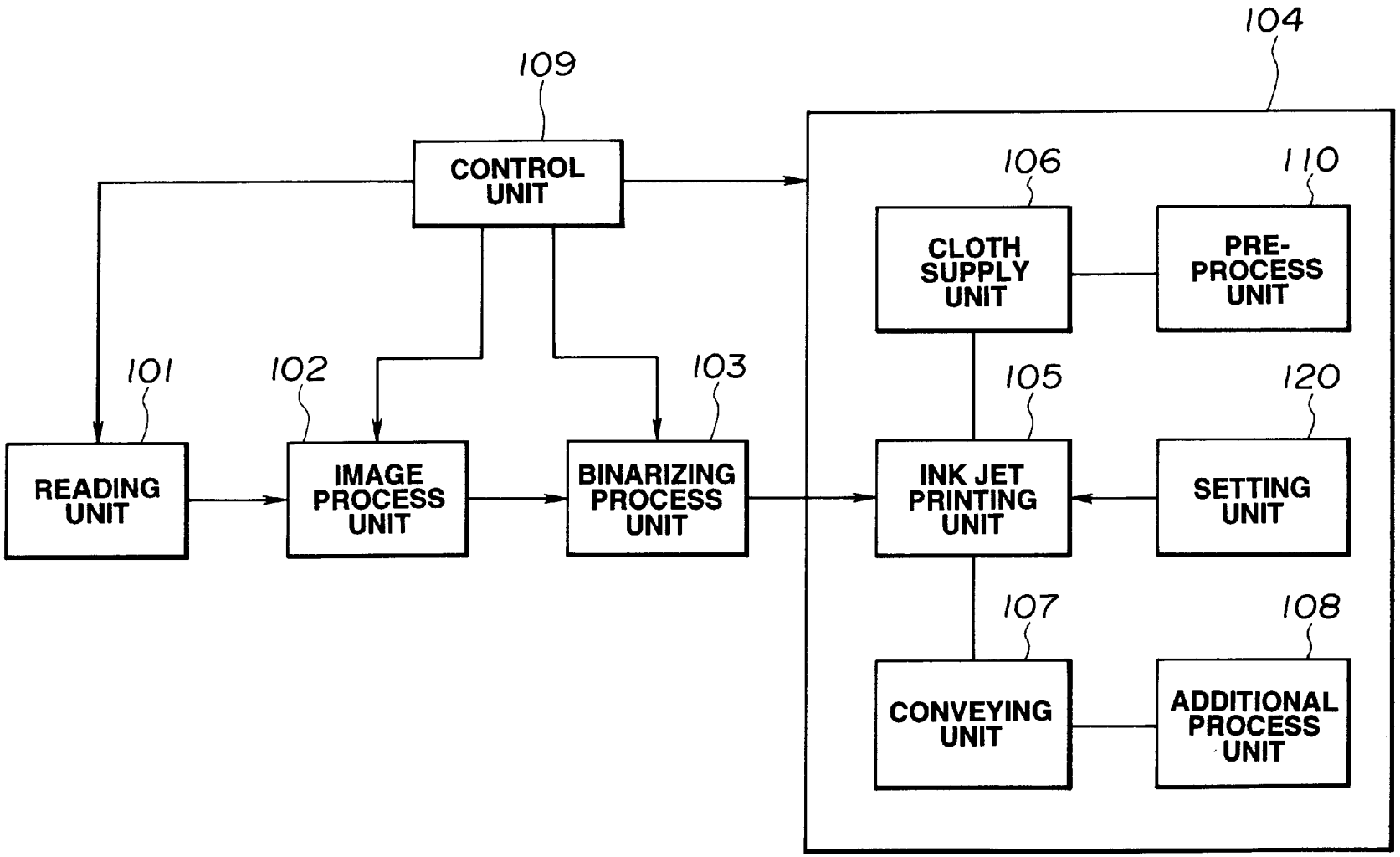
FIG. 1 is a block diagram schematically illustrating an example of an ink jet printed product manufacturing system to which the present invention can be applied.

FIG. 1 is a schematic block diagram showing the configuration of a printing system according to one embodiment of the present invention.

This printing system constitutes a reading unit 101 for reading an original image (for example, created by a designer), an image process unit 102 for processing original image data read by the reading unit, a binarizing process unit 103 for binarizing image data processed by the image process unit 102, an image printing unit 104 for performing printing onto the cloth as the printing medium on the basis of the binarized image data, and a control unit 109 for controlling the aforementioned units.

The image reading unit 101 reads an original image with a CCD image sensor for the output of an electrical signal to the image process unit 102. The image process unit 102 creates print data for driving an ink jet printing unit 105 which discharges inks of magenta (M), cyan (C), yellow (Y) and black (BK), as will be described later, from input original data. Creating recording data involves image processing for reproducing original image with ink dots, coloration for determining color tones, alteration of layout, and selection of the design size such as enlargement or reduction. This image processing and binarizing circuitry is conventional and will not be described in detail here. Further information thereon may be found in U.S. Pat. No. 4,958,236, which is incorporated herein by reference as if set out in full.

The image printing unit 104 comprises an ink jet printing unit 105 for discharging ink based on recording data, a preprocess unit 110 for performing appropriate preprocessing (hereinafter described) on the cloth in preparation for printing, a cloth supply unit 106 for supplying the preprocessed cloth to the ink jet printing unit 105, a conveying unit 107 for precisely conveying the cloth to the ink jet printing unit 105, and an additional process unit 108 for additionally processing and accommodating the cloth as recorded. A setting unit 120 may be provided for variably setting the ink discharge amount in accordance with printing conditions, such as picture element density and the kind of printing medium; this unit is used as required.

Figure 2:
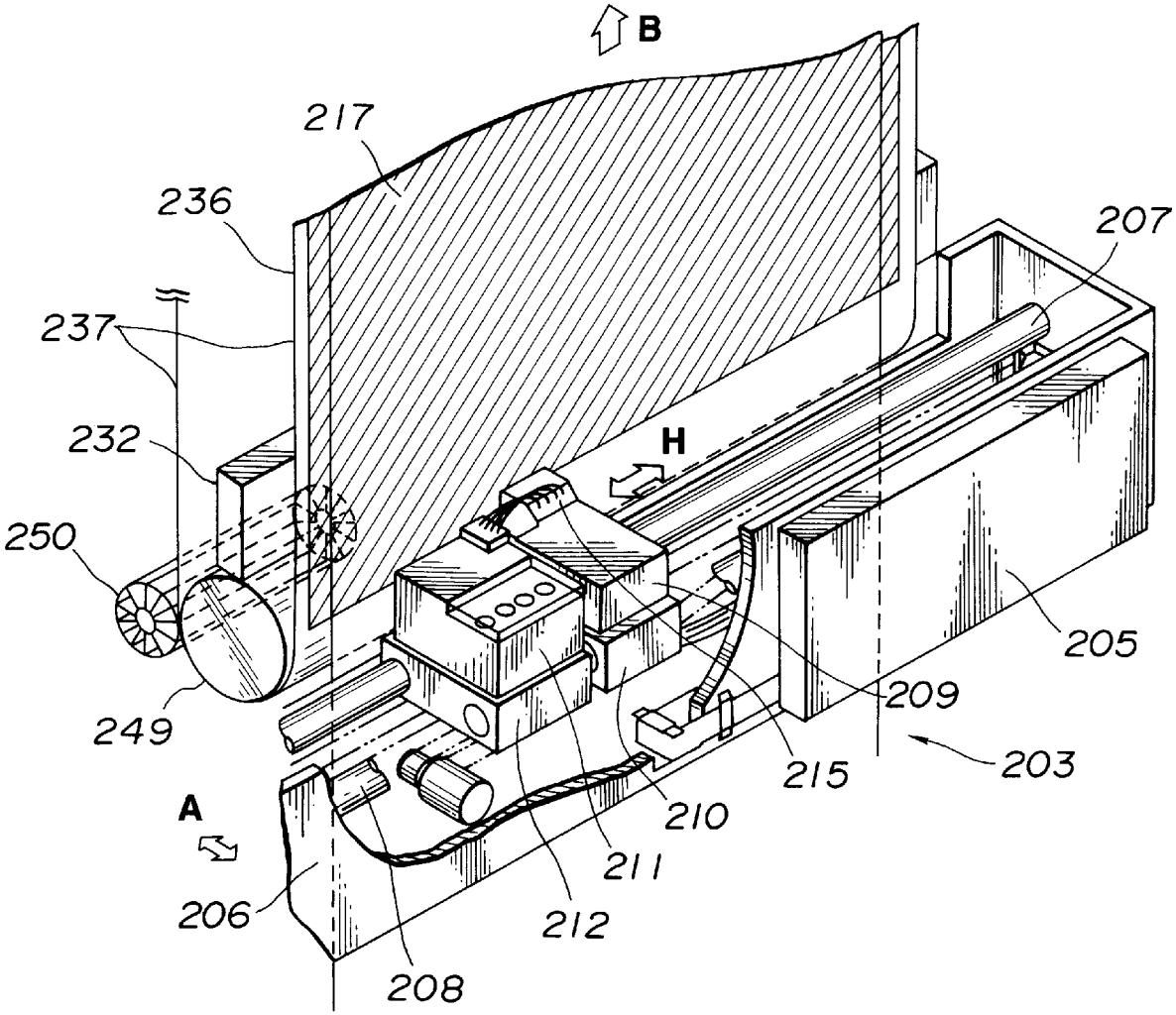
FIG. 2 is a perspective view showing a first embodiment of an ink jet printing unit according to the present invention.

FIG. 2 is a perspective view showing an example of the ink jet print unit of the ink jet printing apparatus according to the first embodiment of the present invention.

Figure 15:
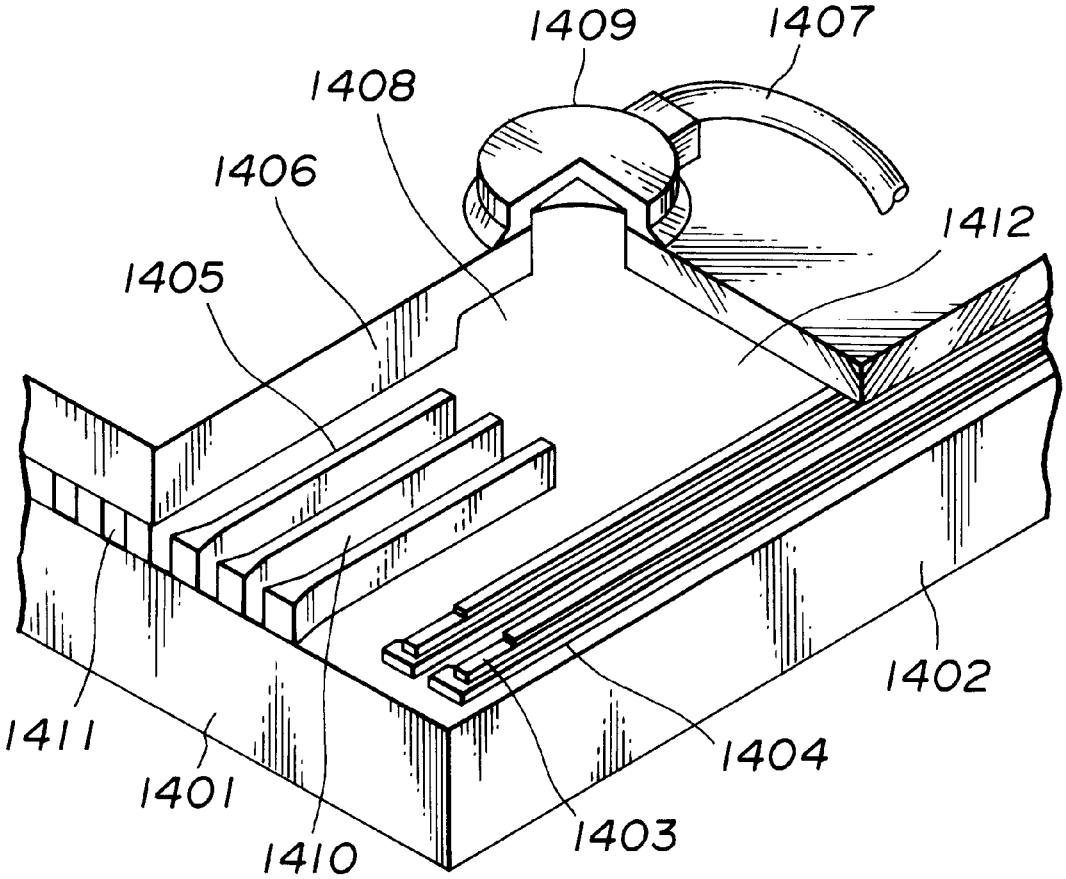
FIG.15 (PRIOR ART)
FIG. 15 is a perspective view, partly broken away, showing the construction of a conventional ink jet printing head.

The ink jet printing unit 203 is largely constituted of a frame 206, two guide rails 207, 208, an ink jet head 209 and a carriage 210 for the movement thereof, an ink supply device 211 and a carriage 212 for the movement thereof, and an electronic system 205. The ink jet head 209 (hereinafter sometimes referred to simply as a head) comprises a plurality of columns of discharge ports, and converters for converting electric drive signals supplied thereto into energy for use in discharging the ink. The printing unit is further provided with means for supplying the drive signals for selectively discharging the ink through the columns of discharge ports, for example, in accordance with an image signal from the binarizing process unit 103. The head may be a print head which discharges the ink by the use of heat energy, as discussed above in connection with FIG. 15.

The ink supply device 211 serves to store ink and supply a necessary amount to the head, and comprises an ink tank and an ink pump (both not shown) or other components. This device 211 and the head 209 are connected via an ink supply tube 215, whereby the head is automatically supplied with the ink, owing to its capillary action, in an amount corresponding to that discharged. In the head recovery operation, ink is compulsorily supplied to the head 209 by using the ink pump.

The head 209 and the ink supply device 211 are mounted on the head carriage 210 and the ink carriage 212, respectively, for reciprocal movement along the guide rails 207, 208 by a driving device, not shown.

Figure 16:
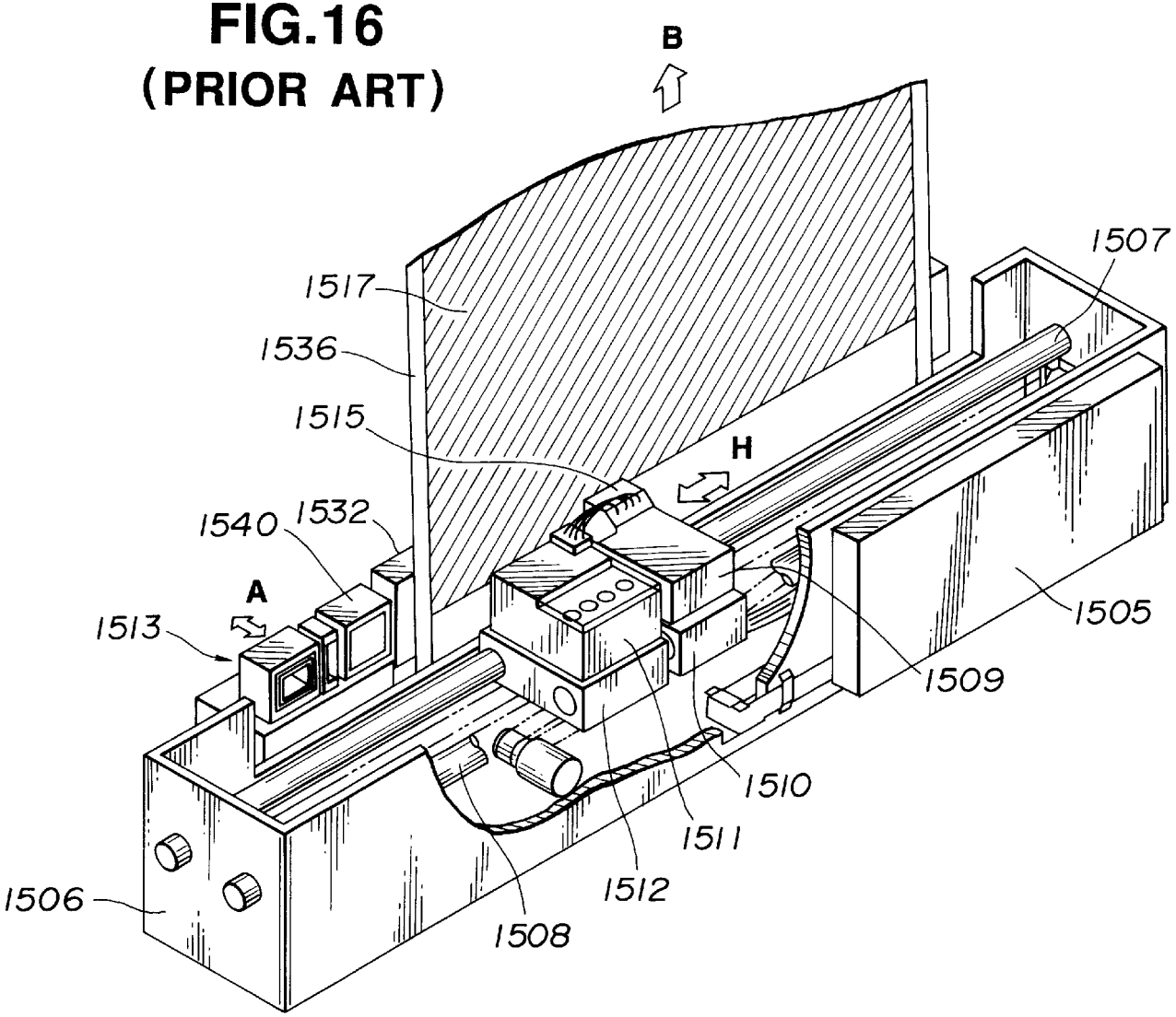
FIG.16 (PRIOR ART)
FIG. 16 is a perspective view, partly broken away, showing the construction of a conventional ink jet printing unit.

A head recovery device (not shown) is provided at a home position (waiting position) of the head and opposed to the head 209. It maintains the stability of the ink discharge from the head 209, as in conventional apparatus, and is movable forward and backward in the direction of the arrow A to perform specific operations similar to those performed by the recovery device described in connection with FIG. 16.

The electronic system 205 comprises a power supply unit and a control unit for controlling the ink jet recording unit. The printing medium comprises cloth 236 conveyed a predetermined distance in a sub-scan direction (the direction of the arrow B) by a conveying device, not shown, every time the head 209 has recorded a predetermined length by moving in a main-scan direction along the guide rails 207, 208, to achieve the formation of an image. In the figure, the shaded portion 217 indicates the recorded portion.

Two long and slender brush-like washing rollers 250 are parallel with a roller 249 and opposite to the ink jet head 209 and are disposed at both ends of the roller 249. (Only the washing roller at the left end of the roller 249 is shown in FIG. 2.) Each washing roller 250 has a hollow cylindrical body, terminating in a closed end, to allow water to pass therethrough, and each has a brush with radial bristles on its outer wall. The open end of each washing roller 250 is connected to a pipe for supplying washing fluid to the washing roller 250 through a rotatable coupler (not shown) and numerous holes are provided from inside the body of the washing roller 250 to its outer wall to allow washing fluid to reach the bristles. In addition, the washing roller 250 is constructed such that it can rotate in the same direction as the roller 249, that is, in the counter-clockwise direction as seen in FIG. 2.

If the printing medium is large, such as a textile or wallpaper, and the pattern (such as a figure) must be continuously printed on the printing medium, the control unit controls the image printing unit 104 such that for each main scan of the head, a print beginning position and a print ending position are set not on the printing medium 236 but on a belt 237 disposed behind the printing medium relative to the head to support the printing medium 236. Thus, both a part of the belt 237 and the printing medium 236 are printed during each scan of the ink jet head 209. In this embodiment, the print width, that is, the distance between the print beginning position and the edge of the printing medium, is set to be 20 mm. In other words, the distance between the print beginning position and the print ending position is greater than the width of the printing medium. (The same is true in the event the printing head is a stationary, full-line printing head, that is, the print width for such a printing head is set to be wider than the printing medium width.)

The printed printing medium 236 is separated from the surface of the belt 237 at the upper portion of the ink jet printing unit 203. The ink discharged onto the right and left sides of the belt 237 (the portions beside the printing medium 236) is washed off by the washing rollers 250, and therefore the ink on the belt 237 is removed and the washed portion of the belt 237 again moves to the position for printing. The washing fluid spouted from the washing rollers 250 is exhausted through a receiver for washing fluid (not shown) located vertically under the washing rollers 250.

According to this embodiment, used ink with high viscosity is not collected by itself from an ink receiver, as in the prior art, but the used ink is collected with washing fluid and the mixture can be exhausted more easily. In addition, a receiver for the washing fluid can be disposed outside the scanning path of the print head, vertically under the washing roller, so that the scanning distance of the print head can be short and the size of the ink jet printer unit can be made compact.

The recording head 209 may be an ink jet recording head for monochrome recording, a plurality of recording heads having different color inks for color recording, or a plurality of recording heads for gradation recording with the same color at different densities. In addition, this apparatus is applicable to a cartridge type system in which the recording head and ink tank are integrated, as well as a type in which the recording head and ink tank are separately provided and connected via an ink supply tube.

With a printing unit described hereinafter, it is possible to provide high quality printing on the printing medium even if the printing medium has poor water absorbability.

Figure 3:
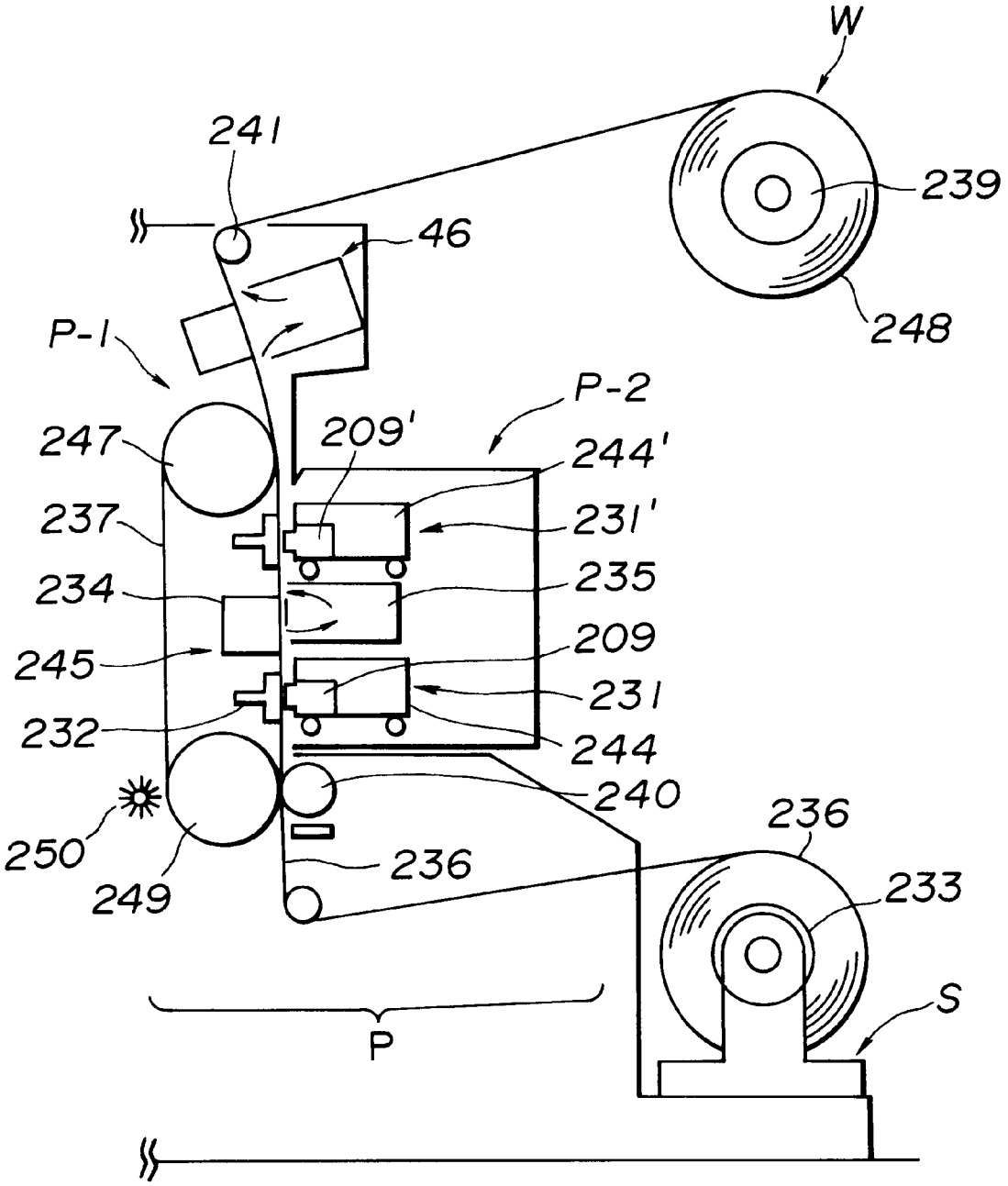
FIG. 3 is a schematic side view of the ink jet printing unit according to the embodiment shown in FIG. 2.
Figure 4:
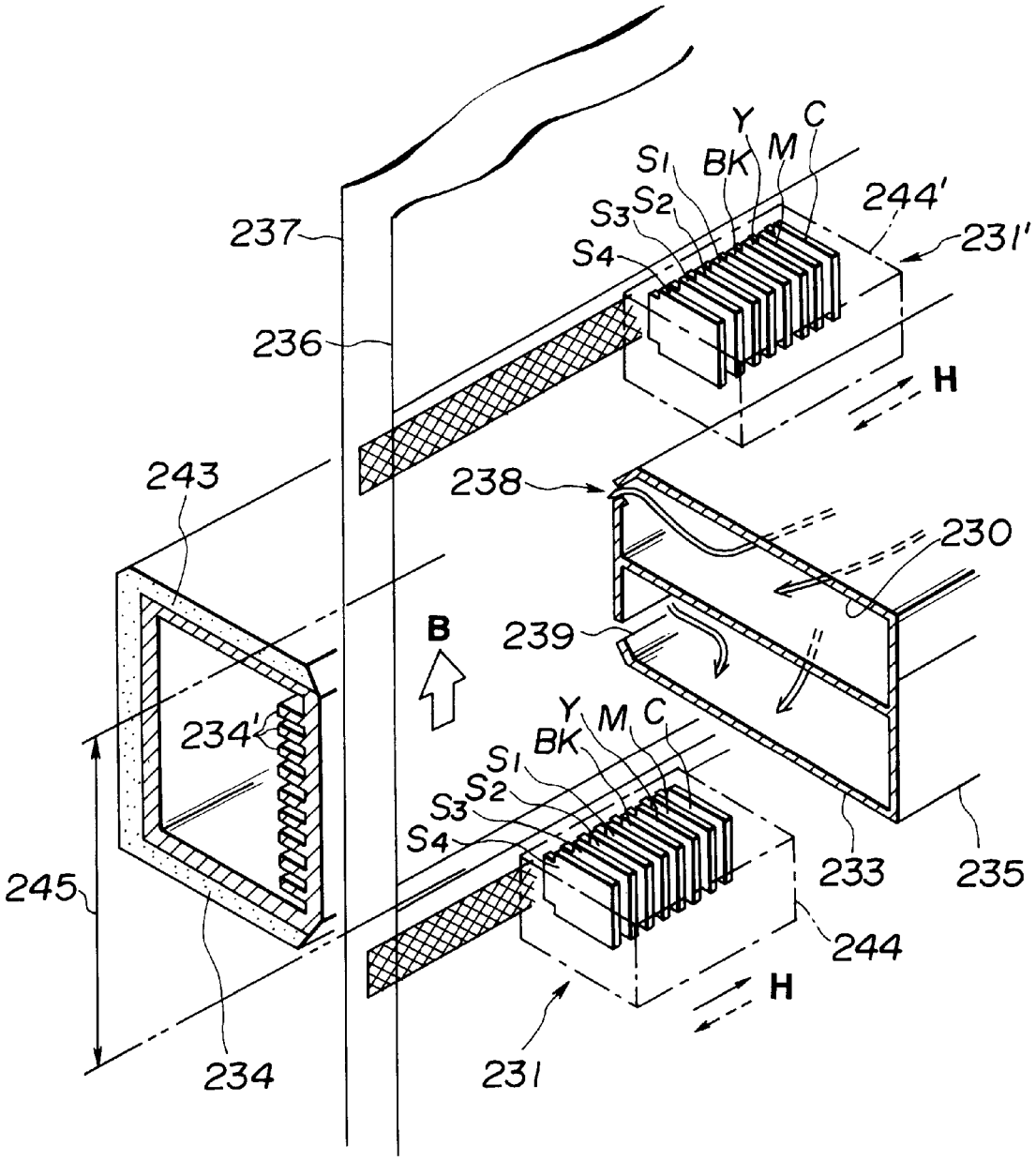
FIG. 4 is a perspective view, partly broken away, of the ink jet heads of the first embodiment and the vicinity thereof.

FIG. 3 is a side view showing schematically an example of a printing unit which incorporates the present invention. The printing unit is largely comprised of a cloth supply unit S for delivering printing medium, such as a cloth 236 pretreated for textile printing and wound around a roller 233, a main unit P for performing the printing by using an ink jet head while precisely feeding the cloth, and a winding unit W having a roller 239 for winding the printed cloth 248 after drying. The main printing unit P further comprises a precision cloth-feeding unit P-1 including a platen 232 and a printer unit P-2. FIG. 4 is a perspective view showing in detail the constitution of the printer unit P-2.

The operation of this apparatus will be now described using an instance of performing textile printing onto pretreated cloth as the printing medium.

The pretreated cloth on roller 236 is delivered from the cloth supply unit S to the main unit P. In the main unit, a thin endless metallic belt 237, which is precisely driven stepwise, is looped around a drive roller 247 and an idler roller 249. The drive roller 247 is directly driven stepwise by a stepping motor (not shown) of high resolution to feed the belt 237 stepwise. The cloth 236 is firmly pressed onto the surface of the belt 237, backed up with the idler roller 249, by a presser roller 240.

The cloth 236 fed stepwise by the belt is positioned at a predetermined position in a first print unit 231 in front of a platen 232 on the printed by t the belt, and printed by the ink jet head 209 on the front side thereof. Every time one line of print is terminated, the cloth is fed by a predetermined step, and then dried through heating by a heating plate 234 disposed on the back side of the belt, in addition to hot air directed against the cloth surface and exhausted therefrom by a hot air duct 235.

Subsequently, in a second print unit 231', overlap printing is performed by an ink jet head 209' in the same way as in the first print unit. The hot air duct 235 may not be necessarily provided, and when it is omitted, air drying (natural drying) is performed in the portion from the first printing unit 231 to the second printing unit 231'.

The printed cloth separated from the surface of the belt 237 is dried again by a post-drying unit 246 similar to the heating plate and the hot air duct as previously described, guided by a guide roll 241, and wound around a winding roll 248. The wound cloth is removed from the main device, and subjected to additional processing such as color fixation, washing, and drying, conveniently performed in batch processing, to provide the final product.

The details of the printer unit P-2 will be described below with reference to FIG. 4. Herein, the preferred embodiment is such that the first print unit head 231 prints information with dots culled out in a staggered manner, the drying station is passed through, and the second print unit head 231' prints the information culled out before printing by the first print unit. In this way, air drying or compulsory drying between each printing makes it possible to further reduce the occurrence of blurred dots when the same quantity of ink is used in a single printhead scan.

In FIG. 4, the cloth 236 or other printing medium is supported by the belt 237 and fed stepwise in an upper direction as shown by the arrow B. In the first print unit 231 at the lower portion of the figure, there is provided a first carriage 244 having mounted ink jet heads of specific colors $S_1$ to $S_4$, as well as C, M, Y and BK. The heads $S_1$ to $S_4$ are used to eject specific inks that enhance color reproduction on the printing medium. For example, bright blue and orange can be difficult to reproduce using cyan, magenta, yellow and black inks, so two of the heads $S_1$ to $S_4$ can be used for those specific colors. The remaining two heads might be used for lower-density (thinner) cyan and magenta inks, to increase the color range obtainable with the print unit. The ink jet head (printing head) in this embodiment has elements for generating heat energy used to discharge the ink, and has 128 or 256 discharge ports arranged vertically with a density of 400 dpi (dots/inch).

Downstream (in the direction B) of the first print unit 231 is provided a drying unit 245 comprised of a heating plate 234 for heating from the back side of the belt 237, and a hot air duct 235 for drying from the front side of the cloth 236. The drying process with this drying unit 245 is mainly intended to evaporate the solvent from the ink on the printing medium, and is different from the diffusion or fixation process described later. A heat transfer surface of the heating plate 234 is pressed against the endless belt 237 tightly tensioned to strongly heat the metallic conveying belt 237 from the back side thereof with a vapor of high temperature and high pressure passing through a hollow tube having a wall thereof comprising the heating plate. On the inner face of the heating plate fins 234' concentrate heat on the back side of the belt. The rest of the tube out of contact with the belt is covered with a heat insulating material 243 to prevent heat loss.

On the front side, the drying effect is further enhanced by blowing against the cloth 236 dry hot air from a supply duct 230 disposed downstream (in the direction B) of the first print unit 231, to direct air of lower humidity toward the cloth 236. A suction duct 233 draws in the air containing additional moisture and flowing in the opposite direction to the conveying direction B of the cloth in a much greater amount than the amount of air provided by the supply duct 230. The water evaporated from the cloth is thus prevented from condensing on any surrounding components. A source of hot air is provided and the hot air is directed to the printing medium through the openings 238, while a suction opening 239 exhausts the vapor-laden air and directs it way from the printing medium. The dimensions of the various components of the drying unit provide even hot air flow over the entire width of the printing medium. The air drying unit is disposed downstream (in the direction B) relative to a center of the heating plate 234, so that air is blown onto an already heated portion of the cloth. Thereby, it is possible to dry a large quantity of the water content of the ink, as well as any solvent or thinner included therein.

Downstream (in the direction B) of the first print unit 231 there is a second print unit 231' which comprises a second carriage 244' of essentially the same constitution as the first carriage 244.

A preferable example of a manufacturing method for ink jet printed products using a printing unit like that in FIG. 3 will be presented below.

Figure 5:
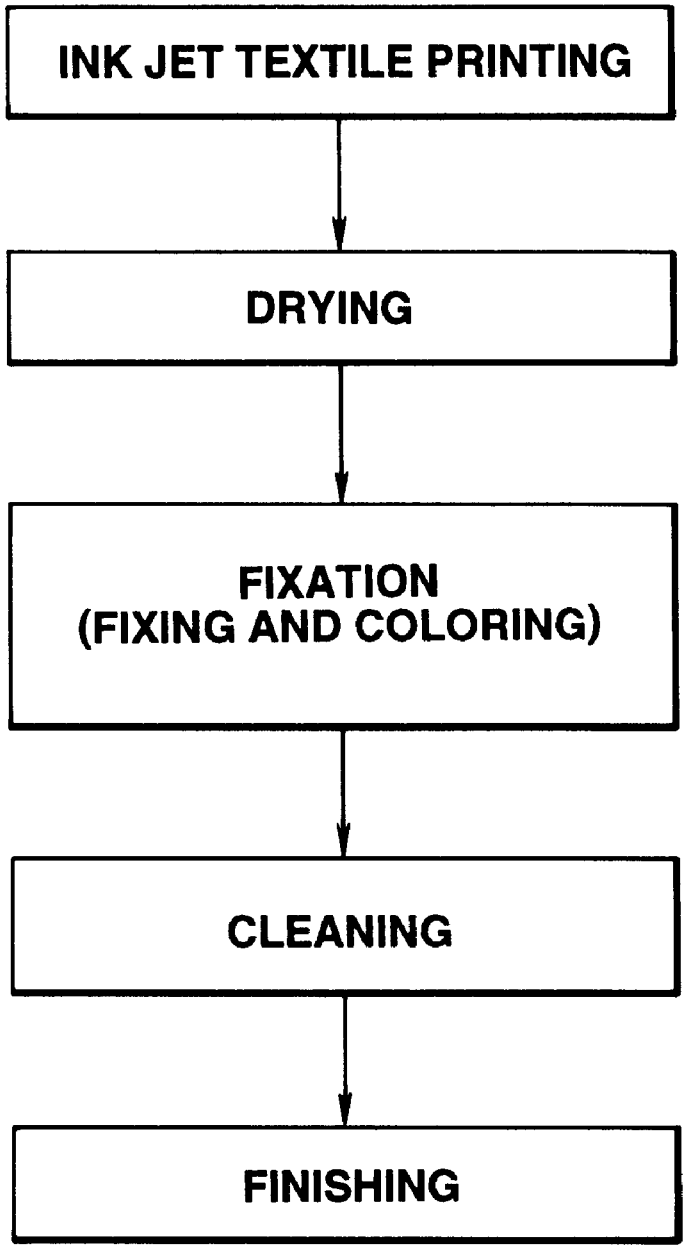
FIG. 5 is a flow chart for explaining a method of manufacturing ink jet printed products according to the present invention.

FIG. 5 is a block diagram for explaining this method, including the steps of ink jet textile printing and drying (including air drying). Subsequently, a step of fixing the textile coloring matter such as a dye in the ink deposited on the textile fibers is performed using means for fixing such coloring matter contained in the ink. This step provides sufficient coloring and fastness to be imparted through fixation of the dye.

The fixation step (including a dye diffusion step and a fixing and coloring step) may be any of the conventional well-known methods, including steaming (e.g., heating the textile to 100° C. under a water vapor atmosphere for ten minutes). In this case, before the textile is printed, it may be subjected to an alkaline pre-treatment. Also, the fixation step may or may not involve a reaction step such as ionic bonding, depending on the dye. The latter example may include impregnating the fiber so as not to cause physical desorption. Also, the ink may be any of the appropriate inks containing a desired coloring matter, which may be not only a dye but also a pigment.

Thereafter, in the cleaning step shown in FIG. 5, any unreacted dye and substances used in the pre-treatment are removed. Finally, a finishing step, such as defect correction and ironing, is performed to complete printing.

Examples of printing mediums to which the invention is applicable are cloth, wall cloth, embroidery thread and wallpaper. The cloth may include any woven or nonwoven fabric and other cloth, irrespective of their materials and how they are woven or knitted. In addition, the cloth may be silk, cotton, hemp, rayon and nylon or the like, or any combination thereof.

In particular, cloths for ink jet textile printing should have the following properties:

(1) the capability of being colored with ink at sufficient densities;

(2) a high ink dyeing rate;

(3) rapid drying of ink deposited on the cloth;

(4) minimal irregular blurring of ink deposited on cloth; and (5) the capability of being smoothly conveyed through the printing apparatus;

To meet these requirements, the cloth may be pre-treated as necessary to improve its suitability for ink jet printing by incorporating in the apparatus means for adding a pre-treatment agent to the printing medium. For example, U.S. Pat. No. 4,725,849 discloses several kinds of cloth having an ink receiving layer and Japanese Patent Publication No. 3-46589 discloses cloth containing a reduction inhibitor and/or alkaline substances. Examples of such pre-treatment include treating the cloth to contain a substance selected from an alkaline substance, water soluble polymer, synthetic polymer, water soluble metallic salt, urea and thiourea.

Examples of suitable alkaline substances include alkaline metal hydroxides such as sodium hydroxide and potassium hydroxide, amines such as mono-, di-, or tri-ethanolamine, and carbonic acid or alkaline metal carbonates and sodium bicarbonate. Further, they can include organic acid metallic salts, such as calcium acetate and barium acetate, and ammonia and ammonium compounds. Also, sodium trichloroacetate which becomes alkaline under dry heating may be used. Particularly preferable alkaline substances may be sodium carbonate and sodium bicarbonate for use in coloring of reactive dyes.

Examples of suitable water soluble polymers include starch substances such as corn and wheat flour, cellulose substances such as carboxymethyl cellulose, methyl cellulose and hydroxyethyl cellulose, polysaccharides such as sodium alginate, gum arabic, locust bean gum, tragacanth gum, guar gum, and tamarind seeds, protein substances such as gelatine and casein, and natural water soluble substances such as tannin and lignin.

Examples of suitable synthetic polymers include polyvinyl alcohol compounds, polyethylene oxide compounds, acrylic acid type water soluble polymers, and maleic anhydride type water soluble polymers. Among such polymers, polysaccharide polymers and cellulose polymers are preferable.

Examples of suitable water soluble metallic salts include compounds having a pH of 4 to 10, which make typical ionic crystals such as halides of alkaline metal and alkaline earth metal. Typical examples of such compounds include alkaline metals such as NaCl, $Na_2AO_4$, KCl and $CH_3COONa$, and alkaline earth metals such as $CaCl_2$ and $MgCl_2$. Among such salts, salts of Na, K and Ca are preferable.

The method of pre-treating the cloth to contain any of the above-cited substances is not specifically limited, but may be normally any one of dipping, pad application, coating, and spray methods.

Further, since the textile printing ink applied to the cloth for ink jet textile printing may adhere only to the surface of the cloth when jetted onto it, the fixation process of fixing coloring matter (such as a dye) in the ink onto the fibers is subsequently preferably performed as previously described. Such fixation process may be any one of conventionally well-known methods, including, for example, a steaming method, or a thermofixing method, and if not using cloth pretreated with alkali, an alkali pad steam method, an alkali blotch steam method, an alkali shock method, and an alkali cold fix method.

Further, the removal of unreacted dye and substances used in pre-treatment can be performed by washing the printing medium in water or hot water having neutral detergent dissolved therein, using means for washing the printing medium, by any of conventionally well-known methods after the fixing process. It is preferable to use any one of conventional well-known fixation processes (for the fixation of dye) jointly with the washing.

The printed products subjected to the additional processes as above described are then cut to desired sizes, and the cut pieces are used to produce final cloth articles using conventional techniques such as stitching, bonding, or welding, to provide, for example, dresses, neckties, swimming suits, bedclothes covers, sofa covers, handkerchiefs, curtains and the like. A number of techniques for processing the cloth by stitching or otherwise to provide clothes or other conventional articles are described in well-known publications, for example, "ONDORI" published by Ondori-sha.

Figure 6:
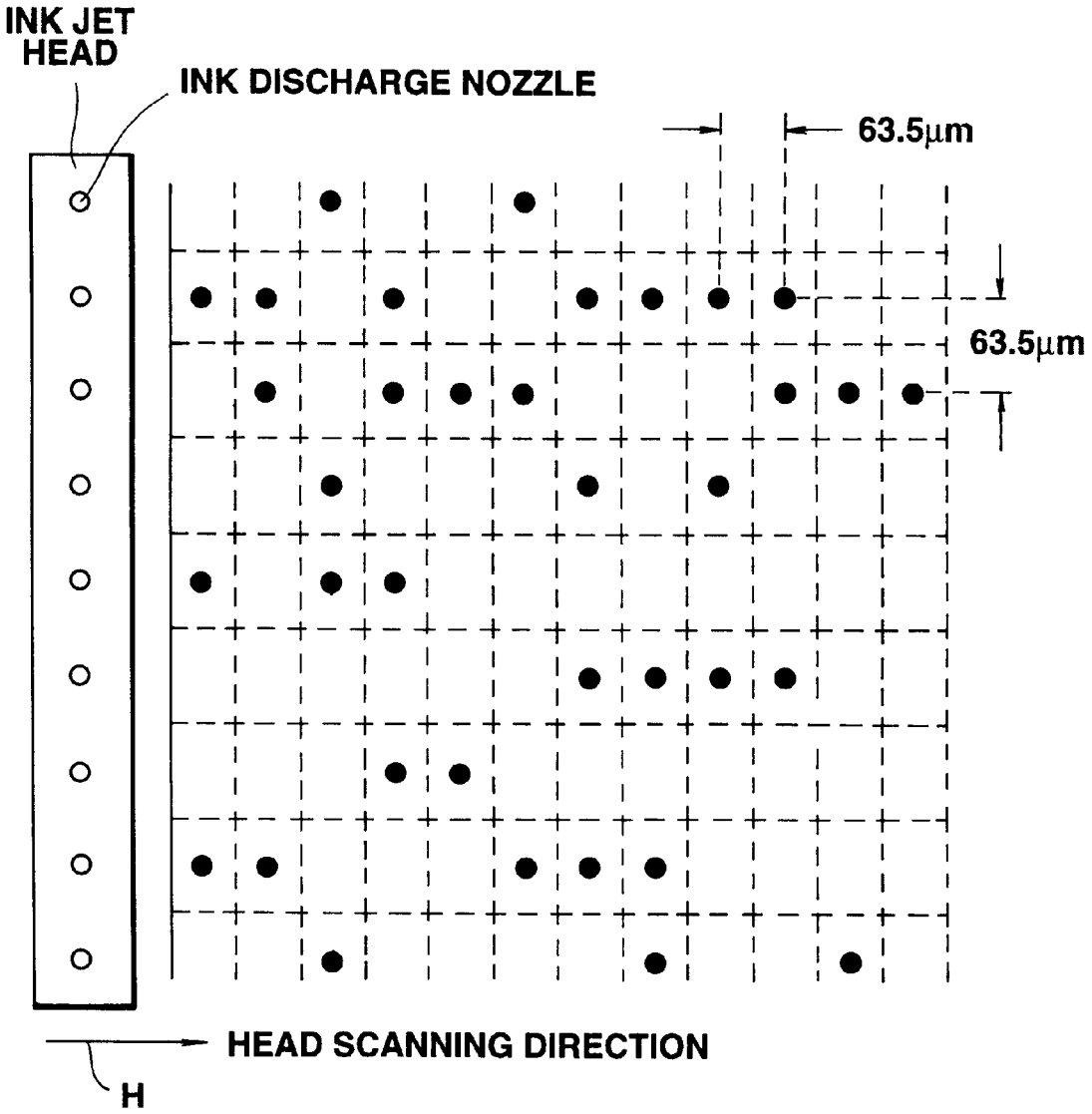
FIG. 6 illustrates a portion of an image formed using structure like that shown in FIG. 4.
Figure 7:
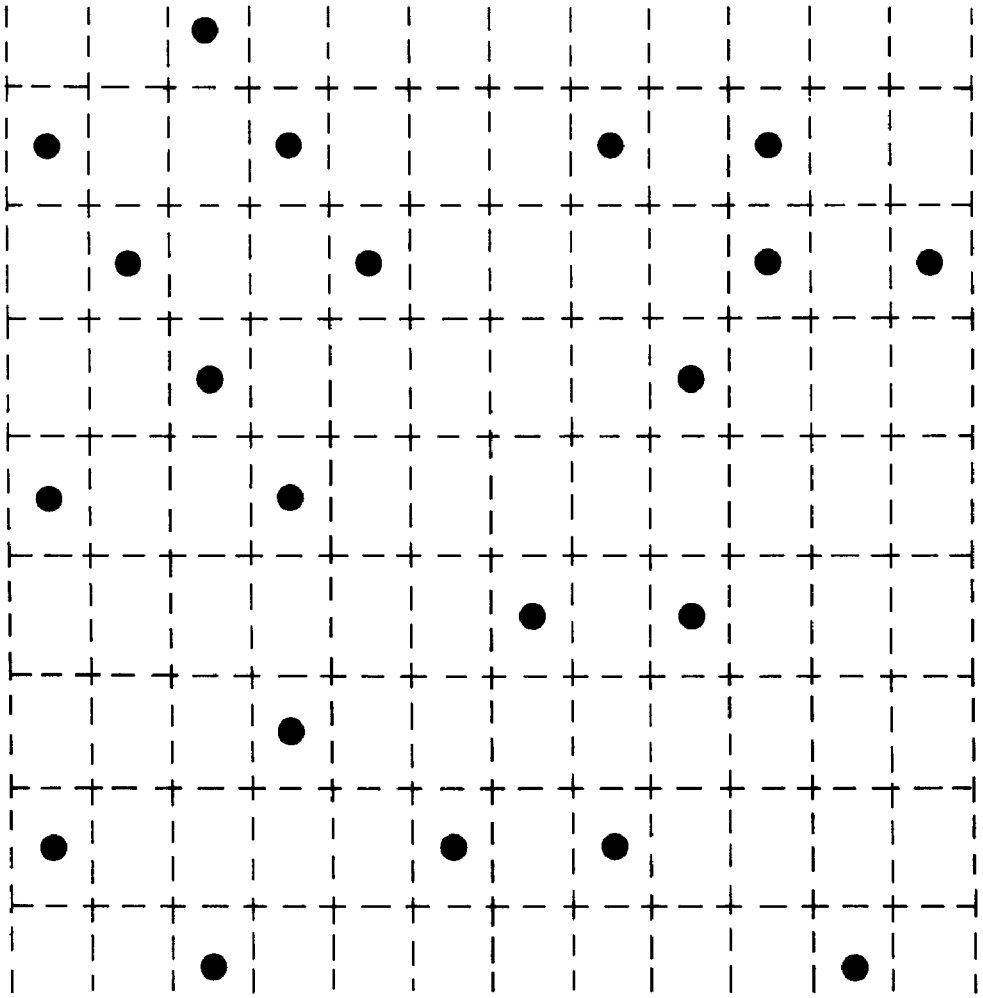
FIG. 7 illustrates the same portion of the image in FIG. 6, with data culled out prior to printing.
Figure 8:
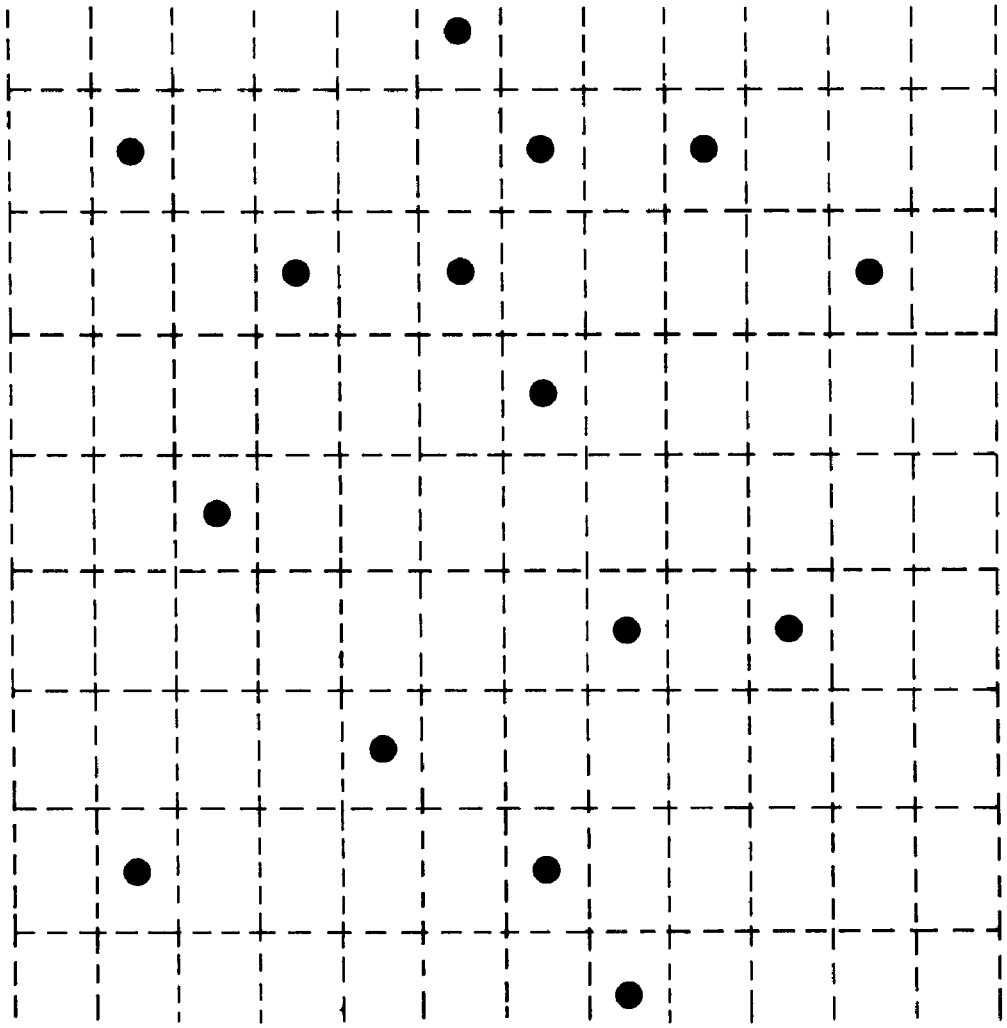
FIG. 8 illustrates the printing of the data culled out prior to printing as illustrated in FIG. 7.

FIGS. 6–8 illustrate the printing of data using a sequential multi-scan technique.

In FIG. 6, each rectangular region surrounded by the dotted lines corresponds to one dot (picture element), wherein if the print density is 400 dpi (dots/inch), each rectangular region is a square with 63.5 $\mu$m sides. In FIG. 6, each region with a black circle has an ink dot printed in it and regions without a black circle are not printed. With the print head moving along the direction of the arrow H, the ink is discharged through ink discharge orifices at predetermined timings. The printed portion in FIG. 6 is produced by two scans, using discharge ports of the lower print head 209 in the first scanning and of the upper print head 209' in the second scanning. Print examples for each scan of this sequential multi-scan technique are shown in FIGS. 7 and 8.

When the data as shown in FIG. 6 is to be printed, only the odd-numbered print data (as numbered along the movement direction of the print head) is first printed by the discharge ports of the lower print head, as shown in FIG. 7. Next, the print head is returned toward the home position, and the cloth 236 is fed by a distance corresponding to the print head width. Thereafter, even-numbered print data is printed by the upper print head, as shown in FIG. 8. Since the heads are spaced in the conveying direction by an integer multiple of one-half of the head width, these two scans print the data as shown in FIG. 6 on the cloth 236.

Figure 9:
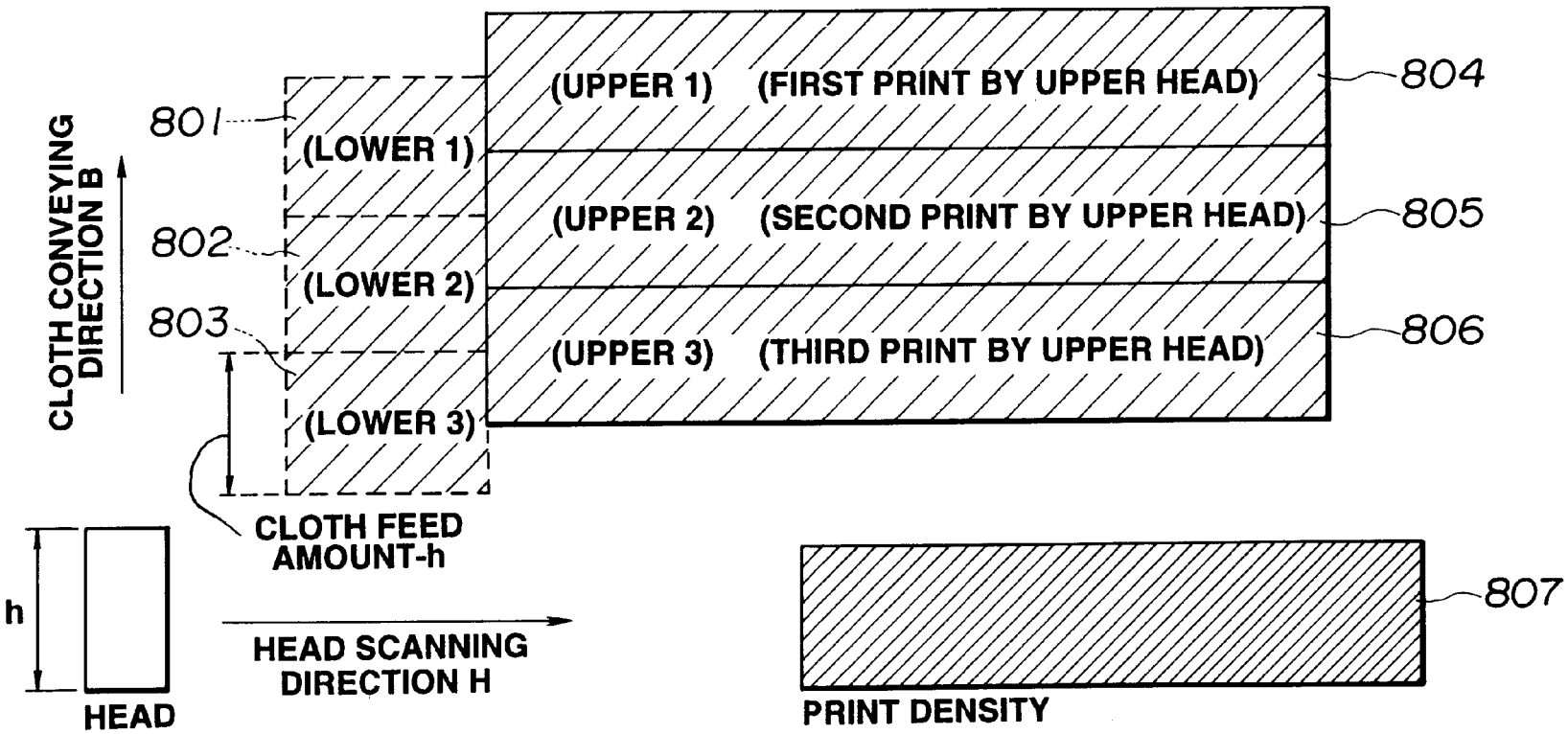
FIG. 9 illustrates the printing sequence employed in the printing method illustrated in FIGS. 6–8.

FIG. 9 shows a more detailed example of this interleaved sequential multi-scan printing using two scans. The areas printed by the print head 209 of the first printing unit 231 are indicated by (Lower 1) 801, (Lower 2) 802, and (Lower 3) 803, and the areas printed by the print head 209' of the second printing unit 231' are indicated by (Upper 1) 804, (Upper 2) 805, and (Upper 3) 806. The upper and lower heads each have a discharge port array with a length h in the cloth feeding direction. The heads are spaced apart I*h/2, where I is an integer.

The cloth conveying direction is as indicated by the arrow B, the step feed amount of the cloth 236 corresponding to a print width (h) of the print head. As explained above, the print head 209 can be used to print odd-numbered dots (FIG. 7) and the print head 209' will be used to print even-numbered dots (FIG. 8). As can be apparent from FIG. 9, the whole print area has been printed by using either the upper half of the print head 209' of the second unit 231' and the lower half of the print head 209 of the first printing unit 231, or the lower half of the print head 209' of the second printing unit 231' and the upper half of the print head 209 of the first printing unit 231. Herein, data printed by each print head is culled out as shown in FIGS. 7 and 8, and the overlap printing by these two print heads 209, 209' results in a print density as indicated by 807.

This sequential multi-scan corrects for differences in density that may occur among the discharge ports, that is, which may cause discrepancies in the size or direction of ink droplets discharged from different discharge ports, because the same line is printed by a plurality of nozzles. By forming one line with discharge ports from different heads, unevenness in print density is reduced owing to randomness in the characteristics of each discharge port.

In addition, according to this embodiment, multi-value printing can also be performed using the first printing unit 231 and the second printing unit 231' on the printing medium. "Multi-value" printing refers to a technique whereby gradations in the image can be represented either by controlling the number of dots per unit area or controlling the size of a dot representing a given pixel of the image.

Next, the second embodiment and the third embodiment of the present invention will be described hereinafter.

Figure 10:
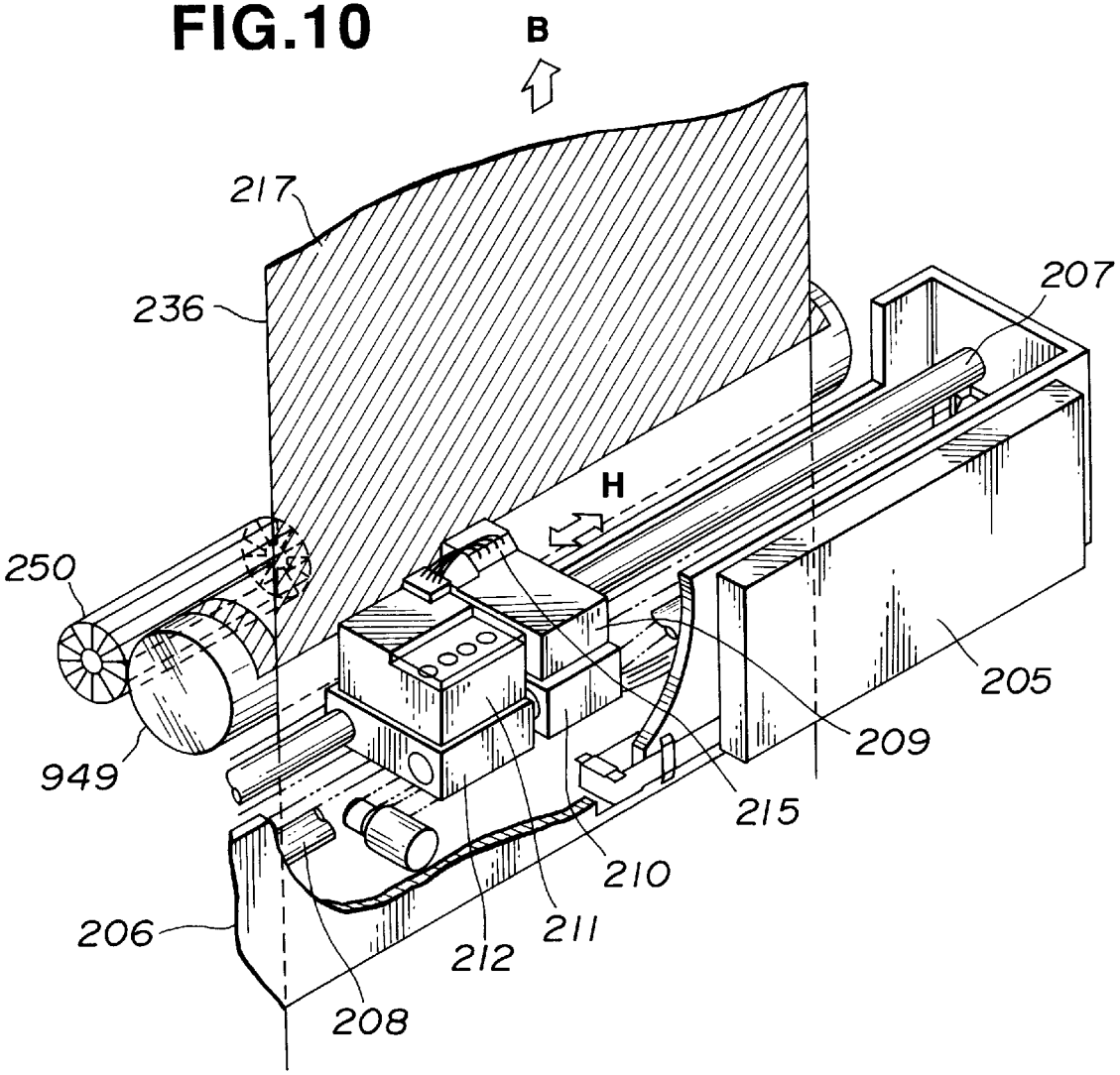
FIG. 10 is a perspective view showing a second embodiment of an ink jet printing unit according to the present invention.

In the second embodiment shown in FIG. 10, in which like features have the same reference numerals as FIG. 2, the ink is discharged on a platen roller 949 and the printing medium 236. Two washing rollers 250 (only one of which is shown) are respectively provided adjacent both ends of the platen roller 949 and on the opposite side of the ink jet head 209 in order to wash the surface of the platen roller 949.

Figure 11:
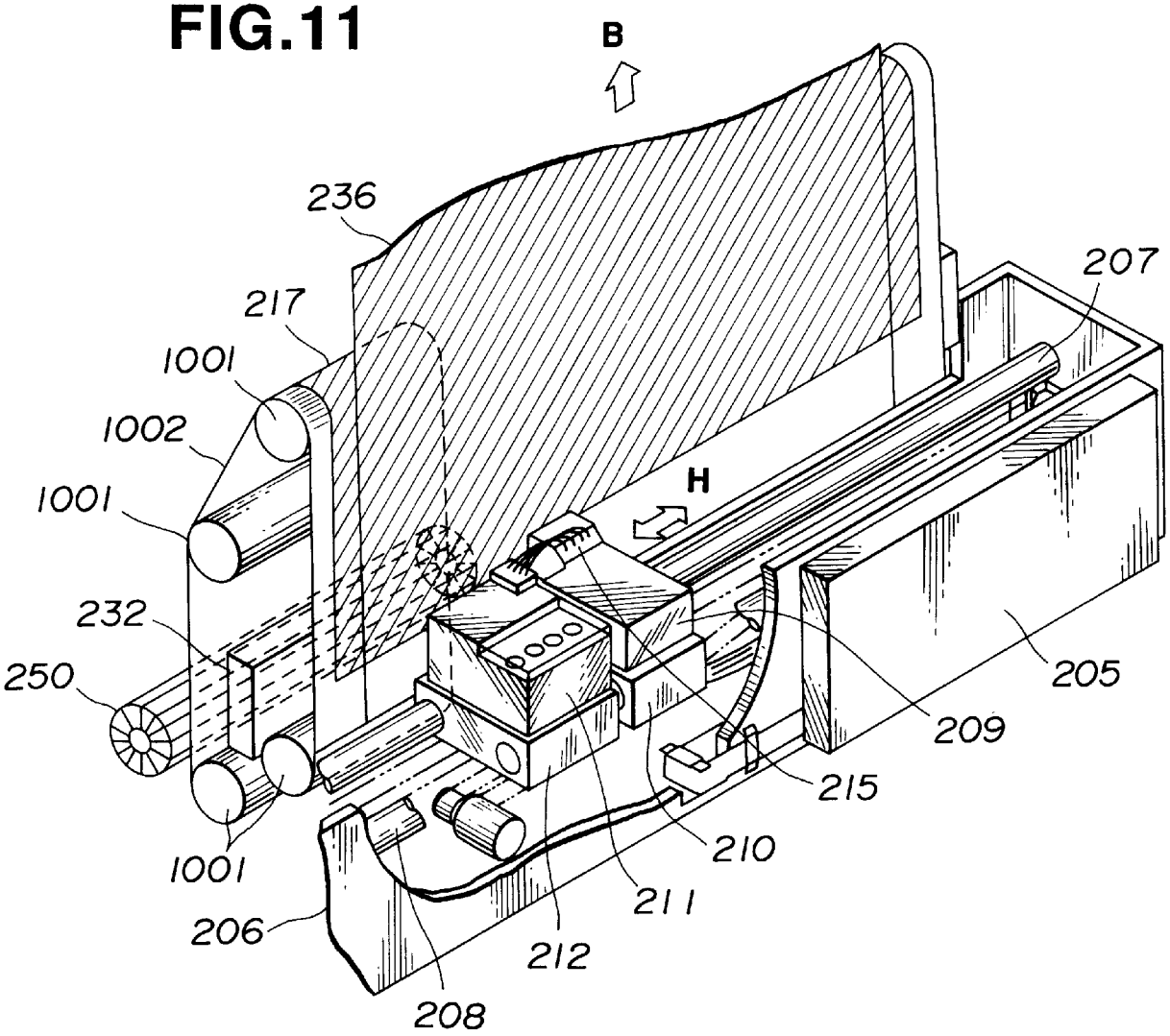
FIG. 11 is a perspective view showing a third embodiment of an ink jet printing unit according to the present invention.

In the third embodiment shown in FIG. 11, in which like features have the same reference numerals as FIG. 2, a belt 1002 is supported by four rods 1001 and is constructed to move around the rods. The ink is discharged on the belt 1002 and the printing medium 236. Two washing rollers 250 are respectively provided facing the belt 1002 and on the opposite side of the ink jet head 209 in order to wash the surface of the belt 1002.

Both the above second and third embodiments have constitutions similar to that of the first embodiment, except for the above-mentioned modifications, and therefore the explanation of similar constituents having the same reference numerals as in FIG. 2 will be omitted.

Additionally, a printing apparatus provided with a recording mechanism using an ink jet printing apparatus according to the present invention may include an image output terminal of an information processing unit such as a computer, as well as a copying machine combined with a reader, etc., and a facsimile machine having a transmission/receiving function.

Figure 12:
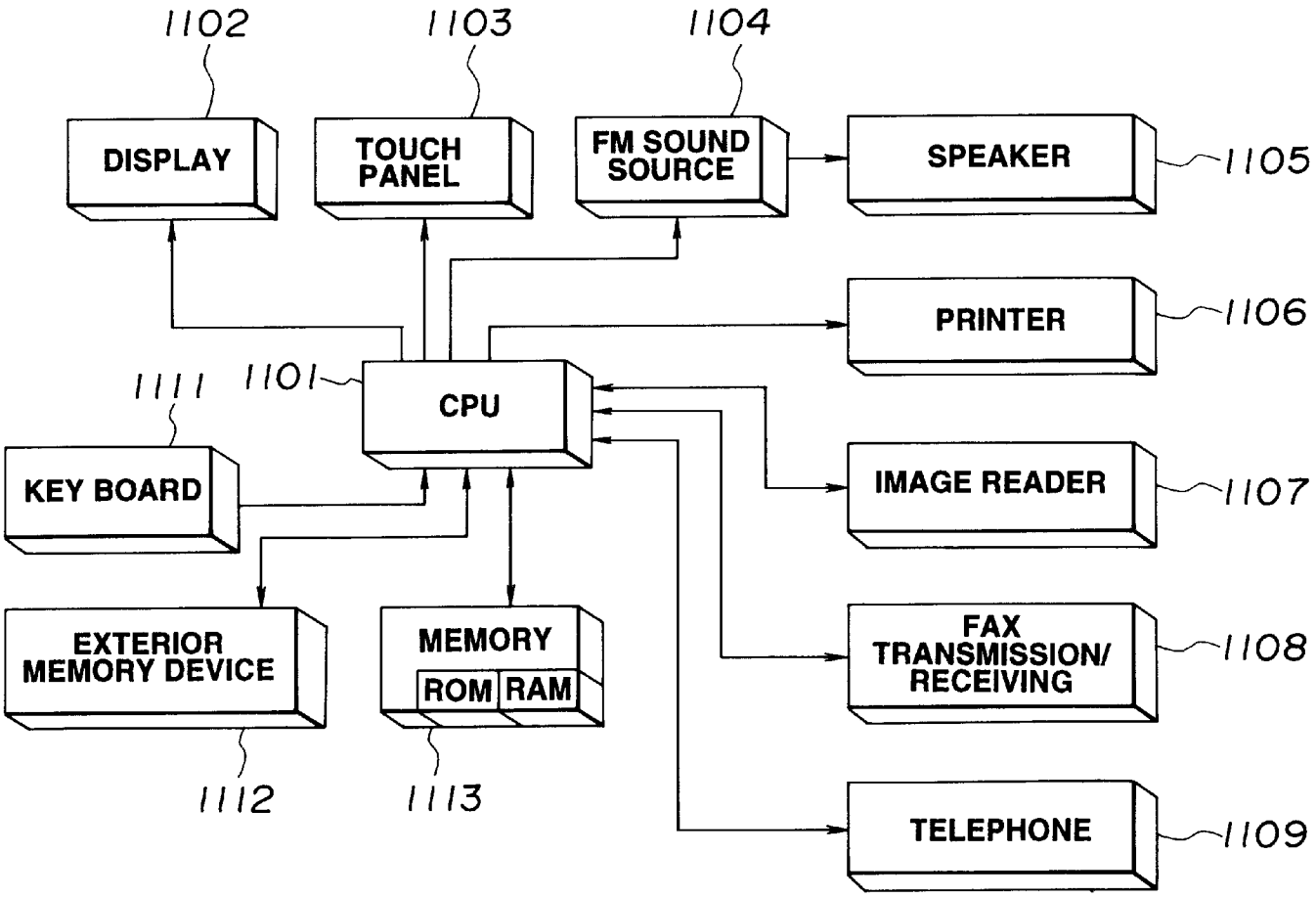
FIG. 12 is a schematic block diagram of an information processing unit to which the present invention has been applied.

FIG. 12 is a block diagram showing a schematic construction of an information processing unit capable of functioning as a word processor, a personal computer, a facsimile machine and a copying machine, to which the recording apparatus of the present invention is applied.

In FIG. 12, 1101 denotes a control part for controlling the whole of an apparatus which is provided with a CPU such as a microprocessor or various kinds of I/O parts, and serves to output control signals or data signals to various parts or to input control signals or data signals from various parts. Numeral 1102 is a display using a display image screen on which various types of menus, document information and image data read by an image reader number 1102 or the like are displayed. Numeral 1103 is a transparent and pressure sensitive touch panel which is provided on the display 1102 and which an operator uses by depressing the surface with a finger.

Numeral 1104 denotes an FM (frequency modulation) sound source part which stores as digital data music information prepared by a music editor or the like in a memory 1113 or an exterior memory device 1112, reads it from the memories and performs FM modulation. An electric signal outputted from the FM sound source part 1104 is converted into audible sound by a speaker 1105. A printer part 1106 to which a recording apparatus of the present invention is applied is used as an output terminal of a word processor, a personal computer, a facsimile machine and a copying machine.

Numeral 1107 denotes an image reader, which serves to photoelectrically read input original documents, and can read facsimile originals and copied originals as well as other various kinds of originals. Numeral 1108 designates a transmission/receiving part of a facsimile (FAX), which serves to receive and decode facsimile transmissions of the original data read by the image reader 1107 or a transmitted facsimile signal, and is provided with an interface function with an exterior side. Numeral 1109 is a telephone part having a variety of functions, such as operation as an ordinary telephone, a caretaking telephone, etc.

Numeral 1113 designates a memory including a ROM which stores a system program or manager program and other application programs, or character fonts, dictionaries, etc., an application program loaded from the exterior memory device 1112, document information, a video RAM or the like.

Numeral 1111 is a keyboard which serves to input document information, various kinds of commands or the like.

The exterior memory device 1112 uses a floppy disk or a hard disk, etc., as a recording medium that can be loaded with document information, music or sound information or the application program of a user, etc.

Figure 13:
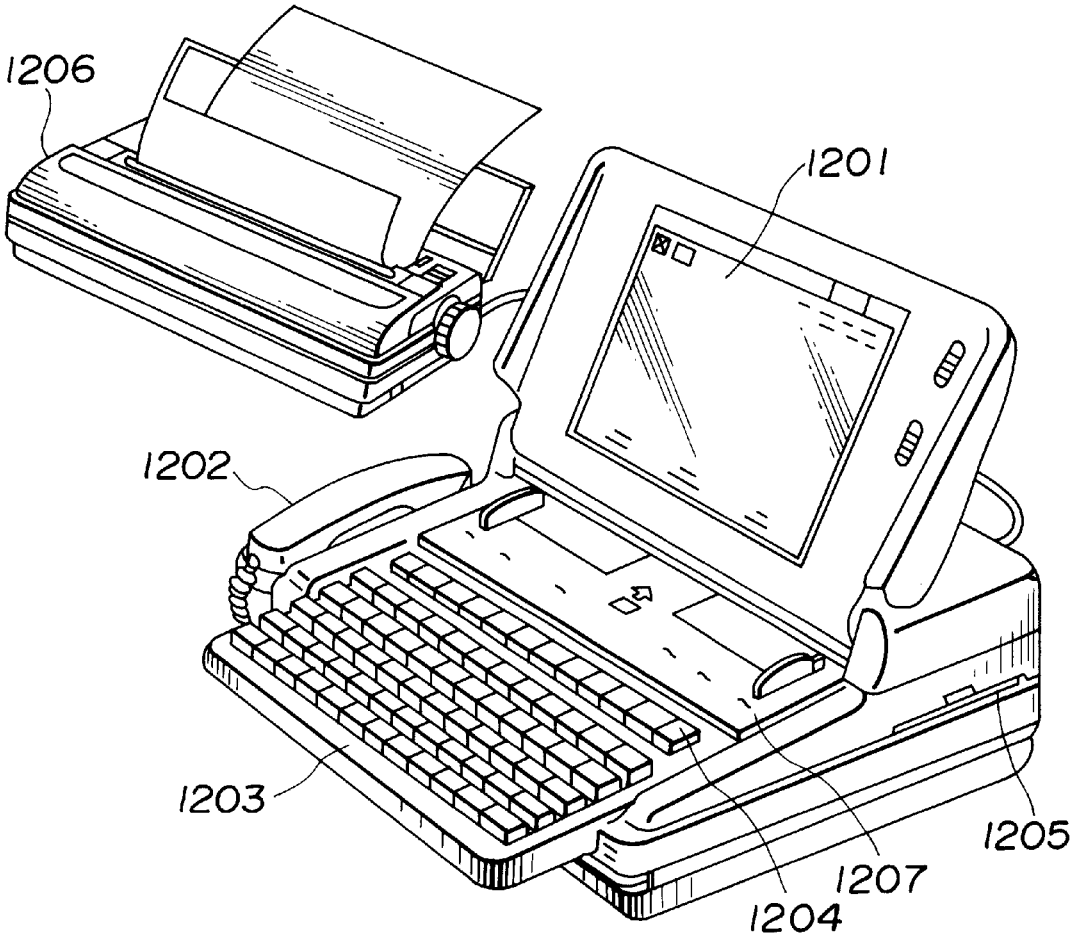
FIG. 13 is a perspective view of the information processing unit shown in block form in FIG. 12.

FIG. 13 depicts a typical information processing unit shown in block diagram form in FIG. 12.

In FIG. 13, 1201 is a flat panel display using a liquid crystal device or the like and serves to display various menus or graphic information and document information, etc. The touch panel is disposed on this display 1201 and coordinates can be inputted or items can be specified and inputted through depression of the surface of the touch panel by using a finger. Numeral 1202 is a handset employed when the unit functions as a telephone. A keyboard 1203 is detachably connected to the main body of the information processing unit and is capable of inputting all sorts of document information and different data. Numerous function keys or the like 1204 are included on the keyboard 1203, and numeral 1205 indicates an insert port for inserting a floppy disk into the exterior memory device.

Numeral 1207 designates a paper mounting part for mounting the original to be read by the image reader 1107. The read original is ejected from a back side of the information processing unit. A received facsimile or the like is recorded by an ink jet printer 1206.

The display 1201 may be a CRT type, but is preferably in the form of a flat panel such as a liquid crystal display making use of a ferroelectric liquid crystal, because that way a compact, thin and light display can be obtained.

In the case where the above information processing unit functions as a personal computer or a word processor, various types of information inputted from the keyboard are processed in accordance with a prescribed program by the control part 1101 and outputted to the printer part 1108 as an image.

In the case where the information processing unit operates as a receiver of a facsimile machine, facsimile information inputted from the FAX transmission/receiving part 1108 through a communication line is received and processed by the control part 1101 in accordance with a prescribed program and outputted to the printer part 1106 as a received image.

In the case where the information processing unit serves as a copying machine, an original is read by the image reader 1107 and the read original data is outputted to the printer part 1106 as a copied image through the control part 1101. In the case where the information processing unit functions as a transmitter for the facsimile machine, the original data read by the image reader 1107 is transmitted and processed by the control part 1101 in accordance with a prescribed program and then transmitted to the communication line through the FAX transmission/receiving part 1108.

Figure 14:
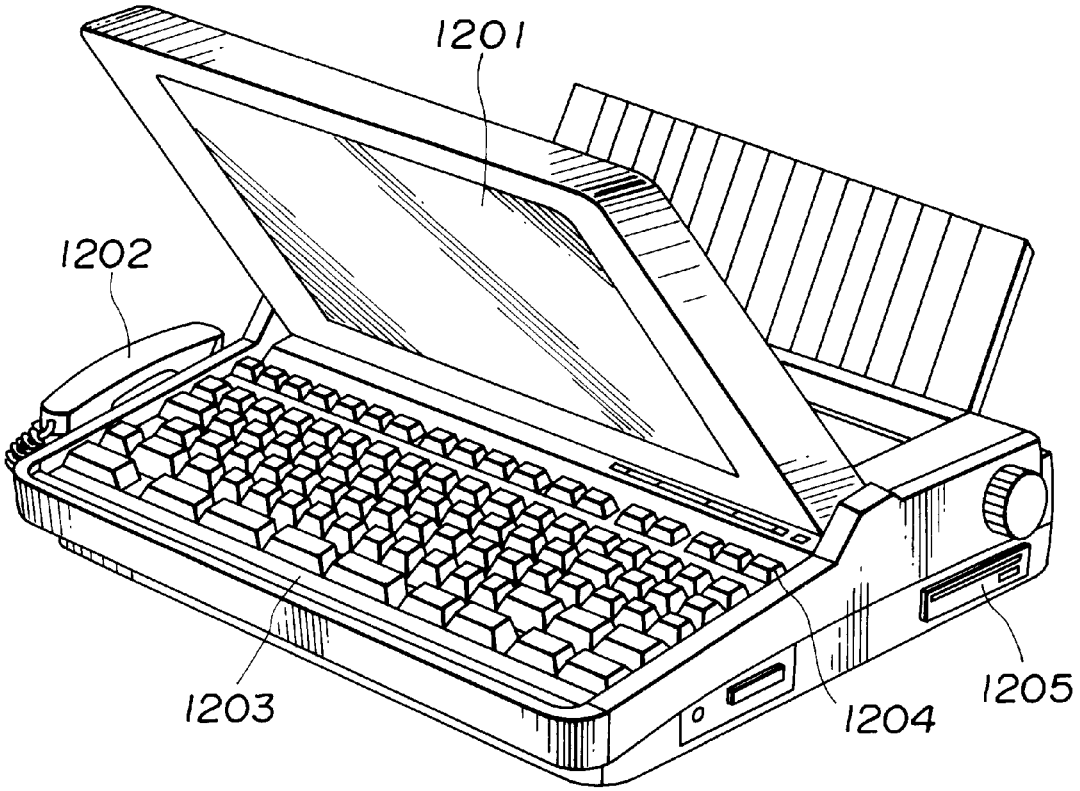
FIG. 14 is a perspective view of a unitary information processing unit.

The information processing unit described above may be a unitary type in which an ink jet printer is built in the main body as illustrated in FIG. 14. In this case, the portability of the information processing unit can be improved. In this figure, portions having the same functions as those in FIG. 13 are marked by corresponding reference numerals.

Since a recorded image of high definition can be obtained at high speed and with less noise by the application of the apparatus of the present invention to the multifunctional information processing unit as set forth above, the functions of the information processing unit can be further enhanced.

The present invention in which the ink is discharged in a printing operation to not only the printing medium but also to means such as a belt for supporting the printing medium has the following advantages.

Firstly, undesirable non-discharge of ink from any rarely used ink jet nozzle of the head can be prevented.

The ink presently used for textile printing has a very high density, so that if the ink is exposed to air for more than about thirty seconds, the viscosity of the ink will be increased, which may result in faulty ink discharge. According to the present invention, however, the ink is discharged to a belt, which acts as means for supporting the printing medium, prior to ink discharge to the printing medium. Therefore, the ink jet head can attain a good discharge condition by the time it begins discharging ink onto the printing medium, so that the possibility of undesirable misdischarge of ink can be reduced.

Additionally, ink may not be naturally discharged to the means which supports the printing medium from an ink jet nozzle when there is no data supplied to the nozzle; however, by discharging of ink from a nozzle adjacent to the unused nozzle, the temperature of the unused nozzle will increase, as a result the viscosity of the ink with high viscosity will be lowered, and therefore the possibility of undesirable misdischarge from the ink jet head can be reduced.

Undesirable mixture of colors on the printing medium can also be prevented. That is, even if a different color of ink is forced into an ink jet nozzle due to wiping of the discharge surface of the ink jet head by a wiping blade, the mixed ink will be discharged onto the means for supporting the printing medium, and not to the printing medium.

Thirdly, according to the present invention, the density of the image printed on the printing medium can be made more uniform.

Since the viscosity of ink decreases as its temperature rises, the amount of ink discharged from the ink jet head may change in accordance with the temperature of the head, and therefore the optical density of the print image on the printing medium may vary. That is, the amount of ink discharged from the ink jet head at the beginning of a printing operation may be different from that at a later time after extensive printing has been performed, due to the difference in temperature of the ink jet head. According to the present invention, however, ink is previously discharged to means for supporting the printing medium before it is discharged to the printing medium, and therefore the temperature of the ink jet head will increase in the initial stage and become stable by the time the ink is discharged to the printing medium. Thus, the amount of ink discharged to the printing medium will not vary during a printing operation, and the optical density of the pattern formed on the printing medium will be more precisely controlled.

The above described advantages are similar to those obtained by a conventional ink discharge operation operated prior to the actual printing operation; however, according to the present invention, the advantages can be obtained without providing a separate ink receiver.

As a result, the whole printing apparatus can be made more compact. According to the present invention, the width of the printing apparatus in a scanning direction of the printing head can be narrowed. Additionally, since the scanning width by the printing head can be narrowed, the printing can be done at high speed, and therefore total printing time can be reduced.

In addition, interruptions in a printing operation can be diminished since there is no need of interrupting a printing operation in order to discharge ink to an ink receiver, or even for removing ink received by the belt.

In the present invention, the distance between where the ink discharge begins and the edge of the printing medium can be suitably determined to provide an effect similar to that obtained by the conventional preliminary ink discharge operation, for example, in consideration of the number of times ink is discharged before recording on the printing medium.

In the above embodiments, the distance can be 0.5~100 mm, preferably 5~60 mm, and more preferably 10~40 mm.

In the above embodiments, an image is printed on the means for supporting the printing medium; however, ink may be discharged to the means from all nozzles of the printing head irrespective of the print image.

In the present invention, in the event the image is printed when the print head on a carriage scans in only one direction, the ink discharge beginning position is set to be a position some distance apart from an edge of the printing medium. On the other hand, if the image is printed during print head movement in both directions, the ink discharge beginning position can be set to be two positions, one of which is some distance apart from a left edge of the printing medium and the other of which is similarly some distance apart from a right edge of the printing medium.

The present invention brings about excellent effects particularly in using a print head of the thermal jet system proposed by Canon Inc., which performs printing by forming fine ink droplets by the use of thermal energy.

As a representative constitution and principle, for example, the basic principle disclosed in, for example, U.S. Pat. Nos. 4,723,129 and 4,740,796 is preferred. Particularly, on-demand type printing is effective because, by applying at least one driving signal which gives rapid temperature elevation exceeding nucleate boiling, electricity-heat converters arranged corresponding to sheets or liquid channels holding a liquid (ink) generate thermal energy to effect film boiling at the heat acting surface of the recording head. Consequently, bubbles within the liquid (ink) can be formed in one-to-one correspondence to the driving signals. By discharging the liquid (ink) through an opening for discharging by growth and shrinkage of the bubble, at least one droplet is formed. By making the driving signals into desired pulse shapes, growth and shrinkage of the bubbles can be effected in a manner that discharges the liquid (ink) with particularly excellent response characteristics.

As the driving signals of such pulse shape, those as disclosed in U.S. Pat. Nos. 4,463,359 and 4,345,262 are suitable. Further excellent recording can be performed using the conditions described in U.S. Pat. No. 4,313,124 concerning the temperature elevation rate of the abovementioned heat acting surface.

As the constitution of the recording head, in addition to the combination of the discharging port, liquid channel, and electricity-heat converter (linear liquid channel or right-angled liquid channel) as disclosed in the above-mentioned respective specifications, the constitution shown in U.S. Pat. No. 4,558,333 or 4,459,600, disclosing the heat acting portion arranged in a flexed region, is also included in the present invention.

In addition, the present invention can also effectively use the constitution disclosed in Japanese Laid-Open Patent Application No. 59-123670, which uses a slit common to a plurality of electricity-heat converters as the discharging portion of the electricity-heat converter, or Japanese Laid-Open Patent Application No. 59-138461, which has an opening for absorbing a pressure wave from the heat energy corresponding to the discharging portion.

In addition, the present invention is effective for a recording head of the freely exchangeable chip type, which enables electrical connection to the main device or supply of ink from the main device by being mounted on the main device, or a recording head of the cartridge type having an ink tank integrally provided on the recording head itself.

Further, the present invention is extremely effective for not only a recording mode using a primary color such as black, etc., but also for recording by color mixing, and the recording heads may be either integrally constituted or combined in plural numbers.

In either case, by using an ink jet textile printing system for representing an image with dot patterns based on digital image processing, the necessity of repetitively printing the same pattern on a textile with conventional textile printing methods is eliminated. That is, for the same continuous cloth, a variety of patterns can be printed contiguous to each other on the cloth, in accordance with the size and shape of the pattern, resulting in the least amount of waste when the cloth is cut. That is, it is possible to perform textile printing and cutting for contiguously arranged patterns in a manner not conceivable with conventional textile printing methods.

Also, when clothes different in size, scheduled number of products, type (design) or pattern, are printed contiguously on one sheet of cloth, it is possible even to provide cutting or sewing lines by using the textile printing system of the present invention, thereby resulting in higher fabrication efficiency.

Further, it is also possible to draw the cutting or sewing lines by digital image processing systematically and effective and effectively, so that the alignment of patterns as sewed can be easily achieved. It is possible also to use a data processor to design comprehensively whether the cutting direction is a texture direction or a bias direction, in accordance with the type or design, thereby making the proper layout on the cloth prior to printing.

As an added advantage, the cutting or sewing lines can be printed using coloring matter which can be washed off after fabrication.

Since the cloth need not be printed outside of areas actually needed for the finished product (such as clothes), wasteful consumption of ink can be avoided.

Note that the preferable inks can be adapted for use with the present invention as follows.

(1) Reactive dye (C.I. Reactive Yellow 95)—10 parts by weight Thiodiglycol—10 parts by weight Diethylene glycol—20 parts by weight Water—60 parts by weight With all the constituents as above cited mixed, the solution is agitated for one hour, and after adjusting pH to pH7 by NaOH, agitating for two hours, and filtering through a Floropore filter FP-100 (trade name, made by Sumitomo Electric), whereby the ink is obtained.

(2) Reactive dye (C.I. Reactive Red 24)—10 parts by weight Thiodiglycol—15 parts by weight Diethylene glycol—10 parts by weight Water—60 parts by weight The ink is then prepared in the same way as in (1).

(3) Reactive dye (C.I. Reactive Blue 72)—8 parts by weight Thiodiglycol—25 parts by weight Water—67 parts by weight The ink is then prepared in the same way as in (1).

(4) Reactive dye (C.I. Reactive Blue 49)—12 parts by weight Thiodiglycol—25 parts by weight Water—63 parts by weight The ink is then prepared in the same way as in (1).

(5) Reactive dye (C.I. Reactive Black 39)—10 parts by weight Thiodiglycol—15 parts by weight Diethylene glycol—15 parts by weight Water—60 parts by weight The ink is then prepared in the same way as in (1).

According to the present invention, ink is discharged as droplets from a print head onto a printing medium such as cloth to form an image from the dots thus deposited on the cloth. The amount of ink discharged from the print head onto the cloth is appropriately set so that the area of a single dot before fixation will be less the desired dot size after fixation. This is because the fibers constituting the cloth cause expansion of the dots. In this fashion, blurring is reduced particularly at the boundaries of overlapping fibers in the cloth, thereby producing ink jet printed products having a high image quality.

It will be appreciated that the present invention has been disclosed in connection with numerous preferred embodiments thereof. Modifications and alterations other than those specifically noted can be made without departing from the spirit or scope of the invention as delineated in the following claims.

What is claimed is:

1. An ink jet printing apparatus for printing an image using a printing head to discharge ink onto a printing medium having a predetermined width in response to drive signals supplied to the printing head in accordance with an image to be printed thereby, the apparatus comprising:

scanning means for moving the printing head relative to the printing medium and beyond edges thereof in the width direction of the printing medium;

control means for setting a print width of the printing head extending between a print beginning position and a print ending position, wherein the print width of the printing head is greater than the width of the printing medium;

drive signal supply means for supplying the drive signals to the printing head to discharge ink therefrom across the print width; and a member extending beyond the print beginning position and the print ending position and disposed behind the printing medium relative to the printing head, wherein said control means controls printing so that the printing head discharges ink on said member while scanning between the print beginning position and one edge of the printing medium, to perform an ink discharge operation, and between the other edge of the printing medium and the print ending position.

2. An ink jet printing apparatus according to claim 1, wherein said member is a rotatable platen roller for conveying the printing medium.

3. An ink jet printing apparatus according to claim 1, further including cleaning means for removing ink from said member.

4. An ink jet printing apparatus according to claim 1, wherein said member is an endless belt having a width extending between the print beginning position and the print ending position and said endless belt is movable for conveying the printing medium.

5. An ink jet printing apparatus according to claim 1, wherein the print beginning position is spaced a predetermined distance from one edge of the printing medium in the width direction and the print ending position is spaced a predetermined distance from another edge of the printing medium in the width direction.

6. An ink jet printing apparatus according to claim 1, further comprising first and second printing heads spaced apart in a sub-scanning direction transverse to the direction of movement of said printing heads, wherein said scanning means includes first and second carriages for scanning the printing medium with said first and second printing heads, respectively.

7. An ink jet printing apparatus according to claim 6, further comprising drying means for drying ink discharged onto the printing medium, said drying means being disposed between said first and second printing heads along the sub-scanning direction for promoting drying of the ink discharged on a portion of the printing medium by said first printing head before ink is discharged onto such portion by said second printing head.

8. An ink jet printing apparatus according to claim 7, wherein said member is disposed for supporting the printing medium at a side opposite said printing heads, said member being movable in the sub-scanning direction for conveying the printing medium.

9. An ink jet printing apparatus according to claim 8, further including cleaning means for removing ink from said member.

10. An ink jet printing apparatus according to claim 9, wherein said cleaning means includes a washing mechanism for directing cleaning liquid against said member.

11. An ink jet printing apparatus according to claim 8, wherein said member includes an endless belt having a portion extending in the sub-scanning direction for contacting the printing medium.

12. An ink jet printing apparatus according to claim 11, wherein said drying means includes a heater behind said endless belt relative to said printing heads for heating the printing medium through said member and a blower for forcing heated air directly onto the printing medium from the side thereof on which said printing heads are disposed.

13. An ink jet printing apparatus according to claim 6, wherein said first and second printing heads record an image by forming dots on the printing medium while being repeatedly scanned relative thereto by said first and second carriages, said first printing head printing selected ones of the dots forming a line of the image and said second printing head printing the remaining ones of the dots forming said line of the image.

14. An ink jet printing apparatus according to claim 13, wherein each line of the image comprises plural, equally-spaced dot locations and said first printing head forms the dots in even-numbered dot locations for a line of the image and said second printing head forms the dots in odd-numbered dot locations for that line of the image.

15. An ink jet printing apparatus according to claim 14, wherein each said printing head comprises plural ink-ejecting nozzles arranged in the sub-scanning direction along a length h and said sub-scanning means conveys the printing medium a distance I*h/2, wherein I is an integer, after the printing medium is scanned.

16. An ink jet printing apparatus according to claim 1, wherein the printing head includes electrothermal converters for generating heat energy to eject droplets of ink toward the printing medium.

17. An ink jet printing apparatus according to claim 1, further comprising image reading means for reading an original image to be printed on the printing medium by the printing head.

18. An ink jet printing apparatus according to claim 1, further comprising image information signal transmitting means for transmitting signals representing the image to be printed on the printing medium.

19. An ink jet printing apparatus according to claim 1, further comprising printing signal input means for inputting signals representing an image to be printed on the printing medium by the printing head.

20. An ink jet printing apparatus according to claim 19, wherein said printing signal input means comprises a keyboard.

21. An ink jet printing apparatus according to claim 1, further comprising sub-scanning means for conveying the printing medium in a sub-scanning direction transverse to the direction of movement of the printing head.

22. A textile printing apparatus comprising:

an ink jet printing apparatus including:

at least one printing head having a plurality of discharge orifices for discharging ink toward a textile printing medium in response to drive signals corresponding to an image to be printed on the printing medium, a scanning mechanism for moving said printing head relative to the printing medium and beyond edges thereof in a width direction, a sub-scanning mechanism for conveying the printing medium in a sub-scanning direction transverse to the direction of movement of said printing head, control circuitry for setting a print beginning position and a print ending position for said scanning mechanism, wherein the print beginning position is spaced a predetermined distance from one edge of the printing medium in the width direction and the print ending position is spaced a predetermined distance from another edge of the printing medium in the width direction, a member extending beyond the print beginning position and the print ending position and disposed behind the printing medium relative to the printing head, wherein said control circuitry controls printing so that the printing head discharges ink on said member while scanning between the print beginning position and the one edge of the printing medium, to perform an ink discharge operation, and between the other edge of the printing medium and the print ending position, and drive signal supply circuitry for supplying drive signals to said printing head to discharge ink therefrom while said printing head is moved by said scanning mechanism, wherein said drive signal supply circuitry supplies drive signals to said printing head to discharge ink therefrom from the print beginning position to the print ending position;

means for drying the printing medium after printing the image thereon;

means for fixing the colors in the printing medium; and means for cleaning the printing medium having the color fixed therein.

23. A textile printing apparatus according to claim 22, further comprising textile feeding means for holding a roll of cloth on which the image is to be printed and textile wind-up means for winding the cloth onto a roll after printing the image thereon.

24. A textile printing apparatus according to claim 22, further comprising first and second printing heads spaced apart in the sub-scanning direction, wherein said scanning mechanism includes first and second carriages for scanning the printing medium and said first and second printing heads, respectively.

25. A textile printing apparatus according to claim 24, further comprising drying means for drying ink discharged onto the printing medium, said drying means being disposed between said first and second printing heads along the sub-scanning direction for promoting drying of the ink discharged on a portion of the printing medium by said first printing head before ink is discharged onto such portion by said second printing head.

26. A textile printing apparatus according to claim 22, wherein each said printing head includes electrothermal converters for generating heat energy to eject droplets of ink toward the textile printing medium.

27. An ink jet printing method for printing an image using a scanning printing head to discharge ink in response to drive signals while scanning a printing medium having a predetermined width, the method comprising the steps of:

setting a print beginning position and a print ending position for the scanning printing head, wherein the distance between the print beginning position and the print ending position is greater than the width of the printing medium;

supplying the drive signals to the printing head to discharge ink therefrom from the print beginning position to the print ending position; and discharging ink onto a member between the print beginning position and one edge of the printing medium, to perform an ink discharge operation, and between the other edge of the printing medium and the print ending position, said member being disposed behind the printing medium relative to the printing head, while scanning the printing head between the print beginning position and print ending position.

28. An ink jet printing method according to claim 25, further comprising the step of removing ink from said member.

29. An ink jet printing method according to claim 25, further comprising the step of providing the printing medium with a pre-treatment agent before printing thereon.

30. An ink jet printing method according to claim 25, wherein the printing medium is a textile.

31. An ink jet printing method according to claim 27, wherein the printing head includes electrothermal converters for generating heat energy to eject droplets of ink toward the printing medium.

32. An ink jet printing apparatus for printing an image on a printing medium having a predetermined width using a printing head to discharge ink in response to drive signals supplied to the printing head in accordance with an image to be printed thereby, the apparatus comprising:

control means for setting a print width of the printing head, wherein the print width of the printing head is greater than the width of the printing medium;

a supporting member for supporting the printing medium disposed behind the printing medium relative to the printing head, the width of said supporting member being greater than the print width; and printing control means for supplying the drive signals to the printing head to discharge ink onto an area having a width corresponding to the print width to print the image, wherein said control means controls printing so that the printing head discharges ink on said supporting member outside of the width of said printing medium, to perform an ink discharge operation.

33. An ink jet printing apparatus according to claim 32, wherein said supporting member is a rotatable plated roller for conveying the printing medium.

34. An ink jet printing apparatus according to claim 32, further comprising cleaning means for removing ink from said supporting member.

35. An ink jet printing apparatus according to claim 32, wherein said supporting member is an endless belt having a width greater than the width of the printing medium, the endless belt being movable for conveying the printing medium.

36. An ink jet printing apparatus according to claim 32, further comprising sub-scanning means for conveying the printing medium in a sub-scanning direction transverse to a direction of movement of the printing head.

37. An ink jet printing apparatus according to claim 32, further comprising first and second printing heads spaced apart in a sub-scanning direction transverse to the direction of movement of said printing heads, wherein said scanning means includes first and second carriages for scanning the printing medium with said first and second printing heads, respectively.

38. An ink jet printing apparatus according to claim 37, further comprising drying means for drying ink discharged onto the printing medium, said drying means being disposed between said first and second printing heads along the sub-scanning direction for promoting drying of the ink discharged on a portion of the printing medium by said first printing head before ink is discharged onto such portion by said second printing head.

39. An ink jet printing apparatus according to claim 38, wherein said member is disposed for supporting the printing medium at a side opposite said printing heads, said member being movable in the sub-scanning direction for conveying the printing medium.

40. An ink jet printing apparatus according to claim 39, further comprising cleaning means for removing ink from said member.

41. An ink jet printing apparatus according to claim 40, wherein said cleaning means includes a washing mechanism for directing cleaning liquid against said member.

42. An ink jet printing apparatus according to claim 39, wherein said member includes an endless belt having a portion extending in the sub-scanning direction for contacting the printing medium.

43. An ink jet printing apparatus according to claim 42, wherein said drying means includes a heater behind said endless belt relative to said printing heads for heating the printing medium through said member and a blower for forcing heated air directly onto the printing medium from the side thereof on which said printing heads are disposed.

44. An ink jet printing apparatus according to claim 37, wherein said first and second printing heads record an image by forming dots on the printing medium while being repeatedly scanned relative thereto by said first and second carriages, said first printing head printing selected ones of the dots forming a line of the image and said second printing head printing the remaining ones of the dots forming said line of the image.

45. An ink jet printing apparatus according to claim 44, wherein each line of the image comprises plural, equally-spaced dot locations and said first printing head forms the dots in even-numbered dot locations for a line of the image and said second printing head forms the dots in odd-numbered dot locations for that line of the image.

46. An ink jet printing apparatus according to claim 45, wherein each said printing head comprises plural ink-ejecting nozzles arranged in the sub-scanning direction along a length h and said sub-scanning means conveys the printing medium a distance I*h/2, wherein I is an integer, after the printing medium is scanned.

47. An ink jet printing apparatus according to claim 32, wherein the printing head includes electrothermal converters for generating heat energy to eject droplets of ink toward the printing medium.

48. An ink jet printing apparatus according to claim 32, further comprising image reading means for reading an original image to be printed on the printing medium by the printing head.

49. An ink jet printing apparatus according to claim 32, further comprising image information signal transmitting means for transmitting signals representing the image to be printed on the printing medium.

50. An ink jet printing apparatus according to claim 32, further comprising printing signal input means for inputting signals representing an image to be printed on the printing medium by the printing head.

51. An ink jet printing apparatus according to claim 50, wherein said printing signal input means comprises a keyboard.

52. An ink jet printing method for printing an image on a printing medium having a predetermined width using a printing head to discharge ink in response to drive signals, the method comprising the steps of:

setting a print width of the printing head, wherein the print width of the printing head is greater than the width of the printing medium;

supplying the drive signals to the printing head to discharge ink therefrom onto an area having a width corresponding to the print width to print the image; and discharging the ink onto a supporting member outside of the width of the printing medium, to perform an ink discharge operation, said supporting member being disposed behind the printing medium relative to the printing head and supporting the printing medium, the width of said supporting member being greater than the print width.

53. An ink jet printing method according to claim 52, further comprising the step of removing ink from said member.

54. An ink jet printing method according to claim 52, further comprising the step of providing the printing medium with a pre-treatment agent before printing thereon.

55. An ink jet printing method according to claim 52, wherein the printing medium is a textile.

56. An ink jet printing method according to claim 52, wherein the printing head includes electrothermal converters for generating heat energy to eject droplets of ink toward the printing medium.

* * * * *